US009699835B2

(12) United States Patent
Yogev et al.

(10) Patent No.: US 9,699,835 B2
(45) Date of Patent: Jul. 4, 2017

(54) MACHINE READABLE ELEMENT AND OPTICAL INDICIUM FOR AUTHENTICATING AN ITEM BEFORE PROCESSING

(75) Inventors: Itzhak Yogev, Kfar HaOranim (IL); Ginat Rachel Muginstein, Even Yehuda (IL); Rony Krysler, Tel Aviv (IL); Emanuel Elyasaf, Rehovot (IL)

(73) Assignee: GOJI LIMITED, Hamilton (BM)

( * ) Notice: Subject to any disclaimer, the term of this patent is extended or adjusted under 35 U.S.C. 154(b) by 908 days.

(21) Appl. No.: 13/885,961

(22) PCT Filed: Nov. 17, 2011

(86) PCT No.: PCT/IB2011/002862

§ 371 (c)(1),
(2), (4) Date: Aug. 9, 2013

(87) PCT Pub. No.: WO2012/066419

PCT Pub. Date: May 24, 2012

(65) Prior Publication Data

US 2013/0334214 A1 Dec. 19, 2013

Related U.S. Application Data

(60) Provisional application No. 61/414,565, filed on Nov. 17, 2010, provisional application No. 61/441,890, filed on Feb. 11, 2011.

(51) Int. Cl.
*H05B 6/64* (2006.01)
*H05B 1/02* (2006.01)

(52) U.S. Cl.
CPC ..... *H05B 6/6447* (2013.01); *H05B 6/645* (2013.01); *H05B 6/6441* (2013.01); *H05B 6/6458* (2013.01)

(58) Field of Classification Search
CPC .... H05B 6/6441; H05B 6/6447; H05B 6/645; H05B 6/6458
(Continued)

(56) References Cited

U.S. PATENT DOCUMENTS 5,285,041 A 2/1994 Wright et al.
5,361,681 A * 11/1994 Hedstrom ..... F24C 7/087 219/413
(Continued)

FOREIGN PATENT DOCUMENTS

DE 10 2008 031378 1/2009
EP 1708118 10/2006
(Continued)

OTHER PUBLICATIONS

PCT International Preliminary Report on Patentability and Written Opinion, dated May 21, 2013, in Application No. PCT/IB2011/002862, 10 pages.
(Continued)

*Primary Examiner* — Quang Van
(74) *Attorney, Agent, or Firm* — Finnegan, Henderson, Farabow, Garrett & Dunner, LLP

(57) ABSTRACT

Apparatuses and methods are provided for a processing apparatus configured to authenticate an item based on at least one optical indicium associated with the item before processing the item. An interface may be configured to receive processing information from a machine readable element associated with an item to be processed. An image acquisition device may be configured to acquire image information relating to at least one optical indicium associated with an item. At least one processor may be configured to verify authentication of the item based upon the image information acquired by the image sensor unit. The processor may be further configured to receive processing infor-
(Continued)

mation from the interface and to determine one or more instructions for processing the item based on the processing information. The apparatus may be further configured to processing the item in accordance with the instructions after the item has been verified as authentic.

17 Claims, 9 Drawing Sheets

(58) Field of Classification Search
USPC ..... 219/702, 705, 709, 711, 506, 413, 490, 219/453; 382/135, 137, 138, 309; 705/1, 705/26; 99/331, 334, 335, 325–328
See application file for complete search history.

(56) References Cited

U.S. PATENT DOCUMENTS

| | | | | |
|---|---|---|---|---|
| 5,426,280 | A | 6/1995 | Smith et al. | |
| 5,504,311 | A | 4/1996 | Dubuis et al. | |
| 6,040,565 | A | 3/2000 | Akerlind | |
| 7,080,593 | B1 | 7/2006 | Frankel et al. | |
| 7,207,486 | B1 | 4/2007 | Bennett et al. | |
| 7,473,869 | B2 | 1/2009 | Chun et al. | |
| 2002/0018138 | A1 | 2/2002 | Yoshiro et al. | |
| 2005/0092844 | A1 | 5/2005 | Zhang et al. | |
| 2005/0139686 | A1 | 6/2005 | Helmer et al. | |
| 2005/0178841 | A1 | 8/2005 | Jones et al. | |
| 2006/0006173 | A1 | 1/2006 | Kim et al. | |
| 2006/0278710 | A1 | 12/2006 | Park et al. | |
| 2006/0289508 | A1 | 12/2006 | Kim et al. | |
| 2007/0007279 | A1* | 1/2007 | Chun | H05B 6/6441 219/506 |
| 2007/0007348 | A1 | 1/2007 | Shah et al. | |
| 2008/0160967 | A1 | 7/2008 | Narasimhan et al. | |
| 2008/0223854 | A1 | 9/2008 | Zeijlon | |
| 2008/0290178 | A1 | 11/2008 | Reynolds et al. | |
| 2009/0172513 | A1* | 7/2009 | Anderson | G06F 17/211 715/210 |
| 2010/0123001 | A1 | 5/2010 | Park | |
| 2012/0111856 | A1* | 5/2012 | Nobue | H05B 6/686 219/704 |

FOREIGN PATENT DOCUMENTS

| | | |
|---|---|---|
| EP | 1742513 | 1/2007 |
| GB | 2444966 | 6/2008 |
| JP | 2005 140418 | 6/2005 |
| WO | WO 92/16083 | 9/1992 |
| WO | WO 95/07007 | 3/1995 |
| WO | WO 2004/059563 | 7/2004 |
| WO | WO 2009/080344 | 7/2009 |

OTHER PUBLICATIONS

PCT International Search Report, mailed on Mar. 14, 2012, in Application No. PCT/IB2011/002862, 4 pages.

* cited by examiner

| Cooking Method | Instructions |
| --- | --- |
| Rare | . . . |
| Medium | |
| Well Done | |
| . . . | |

FIG. 4D

| Dissipation Ratio | Instructions |
| --- | --- |
| DR(1) | Cooking Instructions (1) |
| DR(2) | Cooking Instructions (2) |
| . . . | . . . |
| DR(N) | Cooking Instructions (N) |

FIG. 4E

MACHINE READABLE ELEMENT AND OPTICAL INDICIUM FOR AUTHENTICATING AN ITEM BEFORE PROCESSING

This application claims priority to U.S. Provisional Application No. 61/414,565, filed on Nov. 17, 2010, and to U.S. Provisional Application No. 61/441,890, filed on Feb. 11, 2011, the disclosure of which is incorporated herein by reference in its entirety.

TECHNICAL FIELD

The disclosure relates to processing an item using electromagnetic energy and, more particularly, to methods, devices and apparatuses for authenticating an item using an optical indicium associated with the item before processing the item.

BACKGROUND

Electromagnetic waves have been used in various applications to supply energy to objects. In the case of radio frequency (RF) radiation, for example, electromagnetic energy may be supplied using a magnetron, which is typically tuned to a single frequency for supplying electromagnetic energy only at that frequency. One example of a commonly used device for supplying electromagnetic energy is a microwave oven. Typical microwave ovens supply electromagnetic energy at or about a single frequency of 2.45 GHz.

Traditional methods for processing items using electromagnetic energy typically involve pre-set or user-set cooking times and power levels. For example, when a user desires to cook a frozen pizza in a microwave oven, the user must either manually sets the power level and cook time or, in some instances, the user may select a pre-set time and power setting.

SUMMARY

Presently disclosed embodiments may be directed to an item to be processed using electromagnetic energy. The item may include an object with material receptive to processing using electromagnetic energy, and a machine readable element associated with the object. The machine readable element may contain information used to control at least one aspect of processing the object. Additionally or alternatively, the machine readable element may contain other data, for example, a code that identifies the object. The item may also include one or more optical indicia associated with the object. The optical indicia may be used in the process of authenticating the item. The authentication may depend at least partially on a location of the one or more optical indicia relative to one of more other visible features associated with the item, e.g., the machine readable element.

In some embodiments, one or more of the optical indicia may include at least one of a trademark, a logo, a source indicator, a brand name, or a combination thereof.

Additionally or alternatively, the at least one visible feature may include at least a portion of the machine readable element.

In some embodiments, the machine readable element may be part of the optical indicium.

In some embodiments, the material may include a food item and the information may include information for controlling how the food is cooked or cooking instructions for cooking the food.

In some embodiments, the cooking instructions may include two or more groups of cooking instructions, wherein each group provides a distinct processing outcome for the food item.

For example, the material may include more than one food items and the information may include cooking instructions specific to each food item.

In some embodiments, at least one characteristic of the optical indicium or the machine readable element or both may be configured to change through exposure to the electromagnetic energy or to heat generated by absorption of the electromagnetic energy by the object.

Additionally or alternatively, at least one characteristic of the optical indicium or the machine readable element or both may be configured to change through exposure to changes in temperature or humidity or a combination thereof.

For example, in some embodiments, the change may comprise a transition of the optical indicium or the machine readable element or both to an unrecognizable state for authentication purposes.

In another example, the change may include changes of the information on the machine readable element.

In some embodiments, the information on the machine readable element may include at least one of information associated with an amount of energy to be dissipated by the object during processing, a total amount of energy to be delivered to the object during processing, a predetermined energy dissipation rate associated with the object, a predetermined initial amount of energy to be dissipated by the object or combinations thereof.

In some embodiments, the material may include a food item, and the information may include one or more codes for retrieving cooking instructions from a memory.

In some embodiments, the item may further include at least one positioning element configured to position the item at a predetermined orientation with respect to a reading unit.

In some embodiments, the machine readable element may include an Auto ID Capture (AIDC) element.

For example, the Auto ID Capture (AIDC) element may include at least one of an RFID tag, a barcode, a matrix code, or a combination thereof.

In some embodiments, the machine readable element may include information configured for use with energy absorption information obtained from the object in determining processing instructions for the object.

Presently disclosed embodiments may further include at least one processing device that authenticates an item and then processes the item according to one or more instructions obtained using and/or from a machine readable element associated with the item. In some embodiments, the device may include an interface configured to receive data (e.g., product ID and/or processing information) from a machine readable element associated with an item to be processed. The device may further include an image acquisition device to acquire image information relating to an optical indicium associated with the item. The device may further include at least one processor configured to verify authenticity of the item based upon the image information. The processor may also be configured to cause the item to be processed, after the authenticity of the item is verified, in accordance with one or more instructions based on the data received from the machine readable element.

The processor may cause the item to be processed in accordance with one or more instructions based on the data received from the machine readable element after the item is authenticated.

In some embodiments, the processor may be further configured to receive the data from the machine readable element via the interface and determine the one or more instructions based on the data. In some embodiments, the data may include processing information.

In some embodiments, the processor may be configured to receive the data after the item is authenticated.

In some embodiments, the device may further include an energy application zone and an energy source configured to provide EM energy (e.g., RF energy) to the energy application zone to process the item.

In some embodiments, the device may further include an interface configured to receive processing information from a reading unit configured to read the data from the machine readable element when the object is located at least partially within the energy application zone.

In some embodiments, verifying the authenticity may include receiving an indication from the image acquisition device that the item is authentic.

In some embodiments, the processing information may include one or more of a food type associated with the item, an item weight, a total amount of energy to transfer to the item, an amount of energy to be dissipated in the item, a cooking method to apply to the item, a desired cooking result associated with the item, or a combination of two or more thereof.

In some embodiments, the item may include food to be cooked, and the instructions determined from the processing information may include instructions for cooking the food.

In some embodiments, the authentication may depend at least partially on a location of the optical indicium relative to one or more other features associated with the item.

For example, the one or more other features include at least a portion of the machine readable element.

In some embodiments, the interface may be further configured to receive input information acquired by an input apparatus, and the at least one processor may be configured to determine the one or more instructions for processing the item based on the input information acquired by the input apparatus.

For example, the at least one processor may be configured to provide one or more prompts to a user via the input apparatus based on the processing information from the machine readable element.

In some embodiments, the device may further include a temperature sensor configured to generate an output associated with a temperature of at least a portion of the item, and wherein the at least one processor is configured to cause the processing of the item in accordance with the output of the temperature sensor.

In some embodiments, the device may further include a weight sensor configured to generate an output associated with a weight of the item. In some such embodiments, the at least one processor may be configured to begin processing the item in response to receiving the output from the weight sensor.

In some embodiments, authenticating the item may depend at least partially upon a location of the optical indicium relative to a location of the machine readable element.

In some embodiments, the interface may be configured to receive the processing information from a reading unit configured to read information from the machine readable element.

In some embodiments, the reading unit may be peripherally located with respect to the processing device.

Additionally or alternatively, the reading unit may be configured to establish a wireless communication connection with the interface.

In some embodiments, the reading unit may be integrated with the processing device.

In some embodiments, the reading unit may be an Auto ID Capture (AIDC) reader.

For example, the Auto ID Capture (AIDC) reader may include a reader selected from a group consisting of: a barcode reader, a matrix code reader, and an RFID tag reader.

In some embodiments, the reading unit may include a barcode reader and the device may further include one or more mirrors to increase a field of view of the barcode reader.

In some embodiments, the device may further include at least one positioning element configured to orient the item at a predetermined orientation with respect to the reading unit.

In some embodiments, the processor and/or the interface may be further configured to receive information acquired via a network connection in communication with the Internet and to determine the one or more instructions for processing the item based on the information acquired via the network connection.

In some embodiments, the device may further include a detector configured to provide item information relating to the item to be processed. Additionally, the processor may be configured to determine one or more instructions for processing the item based on the processing information and the item information.

In some embodiments, the detector may be configured to provide the item information based on signals and/or characteristics of signals associated with electromagnetic energy transmitted to or received from the energy application zone.

In some embodiments, the processing instructions may include a specification of an amount of energy to be delivered to the object during processing.

Alternatively or additionally, the processing instructions may include a specification of an amount of energy to be absorbed by the object during processing.

In some embodiments, the item information may include an amount of energy absorbed by the item at a plurality of modulation space elements and the processor may determine the one or more instructions for processing the item based on the amount of energy absorbed by the item at each of a plurality of modulation space elements.

In some embodiments, at least one characteristic of the optical indicium or the machine readable element may be configured to change through exposure to changes in temperature, humidity, exposure to electromagnetic energy, or a combination of two or more thereof.

For example, the change may include transitioning of the optical indicium or the machine readable element or both to an unrecognizable state for authentication purposes. In another example, the change may include changing the information on the machine readable element.

Presently disclosed embodiments may further include a method for processing an item and/or for determining instructions for processing the item. The method may include authenticating the item based on received captured image information relating to at least one optical indicium associated with the item. The method may further include receiving processing information and/or other data (e.g., a code identifying the object) obtained from a machine readable element associated with the item. The method may also include determining, responsive to the authentication, one or more instructions for processing the item based at least partially on the processing information read from the machine readable element.

In some embodiments, the method may further include causing an energy source to apply electromagnetic energy to an energy application zone in accordance with the one or more instructions.

In some embodiments, the method may further include acquiring, from a user, via a user interface, item information regarding the item to be processed before processing. The method may also include determining one or more instructions for processing the item using at least the processing information and the item information.

In some embodiments, the captured image information may include a part of the optical indicium.

Alternatively or additionally, the captured image information may include an indication on the image.

In some embodiments, authenticating the item may include receiving an indication from an image acquisition device that the item is authentic.

Additionally or alternatively, authenticating the item may include comparing the captured image information with a stored image.

In some embodiments, determining the one or more instructions may include accessing a memory, based on the processing information read from the machine readable element, and determining the one or more instructions based on information stored in the memory.

In some embodiments, authenticating the item may depend at least partially upon a location of the at least one optical indicium relative to one or more other features associated with packaging of the item.

For example, authenticating the item may depend at least partially upon a distance between a center point of the machine readable element and a center point of the at least one optical indicium.

In some embodiments, the method may further include acquiring, based on an output of at least one detector, item information from the item to be processed before processing. The method may also include determining one or more instructions for processing the item using at least the processing information and the item information.

For example, the item information may include one or more values associated with electromagnetic energy absorption characteristics of the item.

Additionally or alternatively, the item information may include an amount of energy absorbed by the item.

In some embodiments, the item information may be acquired periodically during the processing of the item. In addition, the processor may be configured to modify the one or more instructions for processing the item based on the periodic determinations.

In some embodiments, the method may further include determining one or more values indicative of energy absorbable in the object (e.g., dissipation ratios) based on the amount of energy absorbed by the item at each of the plurality of modulation space elements and determining the one or more instructions for processing the item based on the one or more dissipation ratios.

The preceding summary is merely intended to provide the reader with an overview of certain aspects of disclosed embodiments and is not intended to restrict in any way the scope of the claims. In addition, it is to be understood that both the foregoing general description and the following detailed description are exemplary and explanatory only and are not restrictive of disclosed principles.

BRIEF DESCRIPTION OF THE DRAWINGS

The accompanying drawings, which are incorporated in and constitute a part of this specification, illustrate various embodiments and exemplary aspects of disclosed embodiments and, together with the description, explain disclosed principles. In the drawings:

FIGS. 4A-4E illustrate exemplary processing information using machine readable elements associated with an item, in accordance with certain disclosed embodiments;

DETAILED DESCRIPTION OF EXEMPLARY EMBODIMENTS

Figure 1:
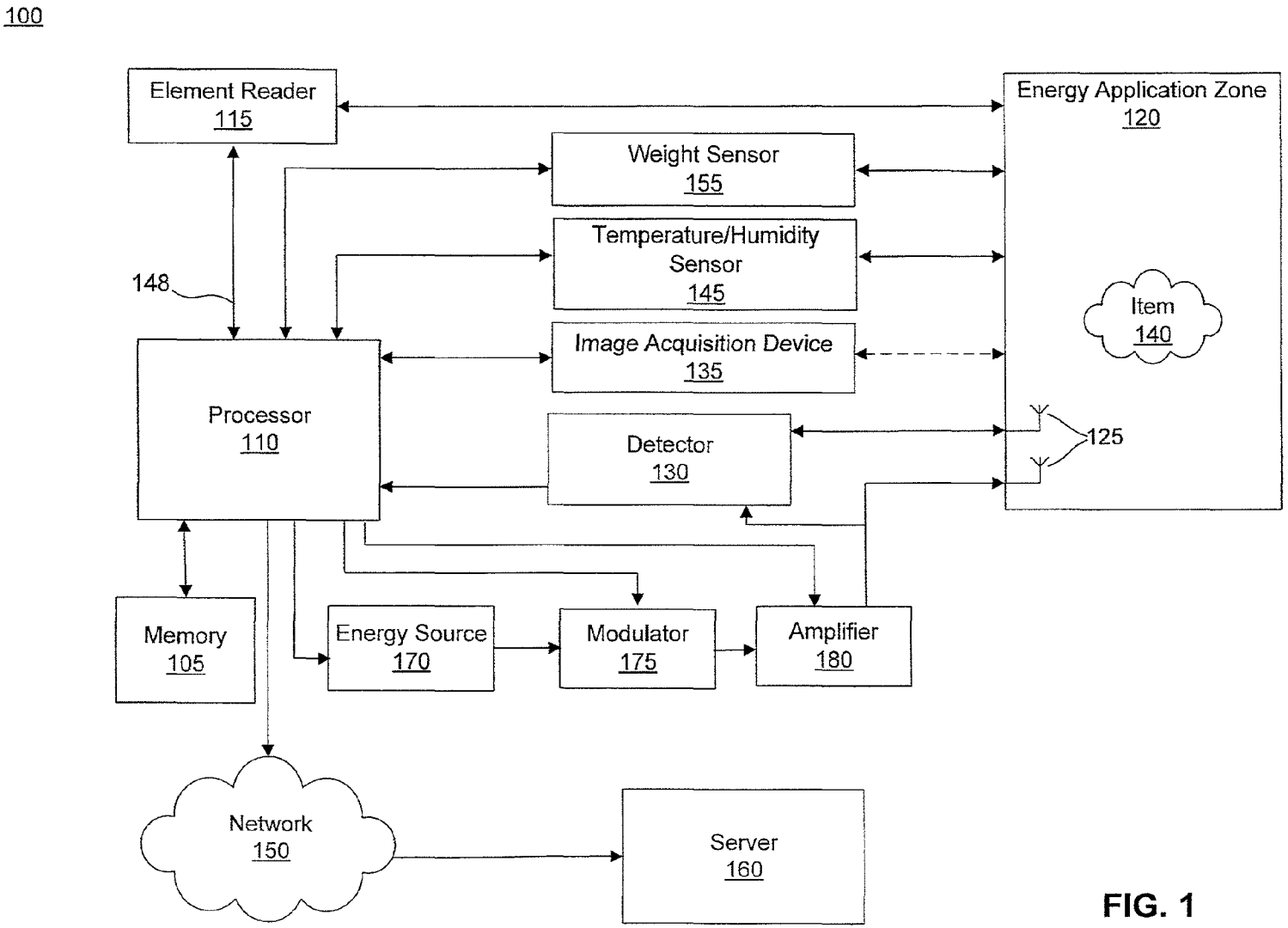
FIG. 1 is a block diagram of an exemplary item processing apparatus, in accordance with certain disclosed embodiments.

Reference will now be made in detail to embodiments, examples of which are illustrated in the accompanying drawings. When convenient, the same reference numbers are used throughout the drawings to refer to the same or like parts.

One aspect of the disclosed embodiments may be directed to methods and/or apparatuses for applying electromagnetic energy to an object in accordance with instructions.

Another aspect of the disclosed embodiments may be directed to methods and/or apparatuses for authenticating an item before processing the item, e.g., by applying electromagnetic energy to the object.

Yet another aspect of the disclosed embodiments may be directed to methods and/or apparatuses for authenticating an item before processing the item in accordance with instructions for applying electromagnetic energy to the object.

The term electromagnetic energy, as used herein, includes any or all portions of the electromagnetic spectrum including, but not limited to, radiofrequency (RF) energy. In one particular example, applied electromagnetic energy may include RF energy with a wavelength of 100 km to 1 mm, which corresponds to a frequency of 300 Hz to 3000 GHz, respectively. In some examples, the applied electromagnetic energy may fall within frequency bands between 500 MHz to 1500 MHz or between 700 MHz to 1200 MHz or between 800 MHz-1 GHz. Microwave and ultra high frequency (UHF) energy, for example, are both within the RF range. Although examples of the embodiments are described herein in connection with the application of RF energy, these descriptions are provided to illustrate exemplary principles, and are not intended to limit disclosed embodiments to any particular portion of the electromagnetic spectrum.

In accordance with some embodiments, an apparatus or method may involve the use of at least one energy source or source configured to apply electromagnetic energy to an energy application zone. A "source" or "energy source" may include any component(s) that are suitable for generating and applying electromagnetic energy. Consistent with some embodiments of the invention, electromagnetic energy may be applied to the energy application zone in the form of propagating electromagnetic waves at predetermined wavelengths or frequencies (also known as electromagnetic radiation). As used consistently herein, "propagating electromagnetic waves" may include resonating waves, evanescent waves, and waves that travel through a medium in any other manner. Electromagnetic radiation carries energy that may be imparted to (or dissipated into) matter with which it interacts.

Moreover, reference to an "object" or "item" is not limited to a particular form. An "item" may include a liquid, solid, and/or gas, depending upon the particular process to be performed, and the item may also include composites or mixtures of matter in differing phases. Thus, by way of non-limiting example, the term "item" may encompass matter such as food to be defrosted, cooked, or heated; clothes or other wet material to be dried; frozen organs to be thawed; chemicals to be reacted; fuel or other combustible material to be combusted; hydrated material to be dehydrated; gases to be expanded; liquids to be thawed, heated, boiled, or vaporized; blood or blood components (e.g., blood plasma or red blood cells) to be thawed and/or warmed; materials to be manufactured; components to be connected; or any other material to be processed by application of electromagnetic energy.

Implementation of disclosed embodiments may benefit various products and industrial, commercial, and consumer processes, such as processes involving the change in state of a particular item. For example, a process may include finishing a product on an assembly line. A process may also include application of energy to an item, regardless of whether the application of energy results in heating. For example, electromagnetic energy may be applied to an object for combusting, thawing, defrosting, cooking, drying, accelerating reactions, expanding, evaporating, fusing, causing or altering biologic processes, medical treatments, preventing freezing or cooling, maintaining the object within a desired temperature range, or any other application where a desire to perform such a process exists.

FIG. 1 is a block diagram of an exemplary item processing apparatus 100. Apparatus 100 may include or be an oven, chamber, tank, dryer, thawer, dehydrator, reactor, furnace, cabinet, engine, chemical or biological processing apparatus, incinerator, material shaping or forming apparatus, conveyor, combustion zone, or any other such system where it is desirable to process an item.

Apparatus 100 may include a memory 105 and a processor 110. As used herein, the term "processor" may include an electric circuit that executes one or more instructions. For example, processor 110 may include one or more integrated circuits, microchips, microcontrollers, microprocessors, embedded processors, all or part of a central processing unit (CPU), graphics processing unit (GPU), digital signal processor (DSP), field-programmable gate array (FPGA), or other circuit suitable for executing instructions or performing logic operations. Processor 110 may, for example, be programmed to execute instructions operable to cause apparatus 100 to transfer, supply, and/or apply electromagnetic energy to an item 140 located in an energy application zone 120 of apparatus 100. Instructions executed by processor 110 may be stored in memory 105. Memory 105 may be part of apparatus 100, part of processor 110, or may be remotely located and in communication with processor 110, for example, via a network 150 through wired communication, wireless communication, and/or the Internet. In certain embodiments, memory 105 may be located at a server 160. Memory 105 may include a random access memory (RAM), a read-only memory (ROM), a hard disk, an optical disk, a magnetic medium, a flash memory, other permanent, fixed, volatile memory, non-volatile memory, or any other tangible mechanism capable of providing instructions to processor 110.

Processor 110 may represent one or more processors. If more than one processor is employed, all may be of similar construction, or they may be of differing constructions electrically connected or disconnected from each other. As used herein, "construction" may include physical, electrical, or functional characteristics of the processor. Processors may be physically or functionally separate circuits or integrated in a single circuit. When more than one processor is used, they may be configured to operate independently or collaboratively. Collaborating processors may be coupled electrically, magnetically, optically, acoustically, mechanically, wirelessly or in any other way permitting at least one signal to be communicated between them. As depicted in FIG. 1, exemplary processor 110 may be operatively coupled to various components of apparatus 100 using, for example, optical, electrical, wired or wireless, or other communication channels, and may be configured to execute instructions that regulate one or more of these components.

Apparatus 100 may also include an energy application zone 120. Energy application zone 120 may be any location where a process is performed on an item, for example, an assembly line or an appliance. By way of non-limiting example, energy application zone 120 may be any cavity, void, location, region, or area where electromagnetic energy may be applied. It may include a hollow, or may be filled or partially filled with liquids, solids, gases, or combinations thereof. By way of example only, energy application zone 120 may include the interior of an enclosure (e.g., a cavity), interior of a partial enclosure (e.g., conveyor belt oven), interior of a conduit, open space, solid, or partial solid that allows for the existence, propagation, and/or resonance of electromagnetic waves. Energy application zone 120 may be permanent or may be temporarily constituted for purposes of energy application.

Energy application zone 120 may have a predetermined configuration or a configuration that is otherwise determinable, so long as physical aspects of its configuration are known at a time of energy application. Energy application zone 120 may assume any shape that permits electromagnetic wave propagations inside the energy application zone. For example, all or part of energy application zone 120 may have a volume that is spherical, hemispherical, rectangular, toroidal, circular, triangular, oval, pentagonal, hexagonal, octagonal, elliptical, or any other shape or combination of shapes. It is also contemplated that energy application zone 120 may be closed, e.g., completely enclosed by conductor materials, bounded at least partially, or open (e.g., having non-bounded openings). The general methodology applicable to the presently disclosed embodiments is not limited to any particular zone, configuration, or degree of closure.

By way of example, energy application zone 120, (e.g., a resonant cavity), is illustrated schematically in FIG. 1, where item 140 is positioned in energy application zone 120. It is to be understood that item 140 need not be completely located within the energy application zone. That is, item 140 may be considered to be "in" energy application zone 120 if at least a portion of the item is located in zone 120.

Energy application zone 120 may be designed with dimensions permitting it to be resonant in a predetermined range of frequencies (e.g., the UHF or microwave range of frequencies, such as between 300 MHz and 3 GHz, or between 400 MHz and 1 GHz, or in an ISM band, e.g., between 2400 and 2500 MHz, or in any other portion of the radio frequency range of the electromagnetic spectrum). Alternatively or additionally, energy application zone 120 may be designed with dimensions permitting waves in a predetermined range of frequencies to propagate in the cavity.

Apparatus 100 may also include an energy source 170, which generates electromagnetic energy. For example, energy source 170 may be a magnetron configured to generate high power microwave waves at a predetermined wavelength or frequency. Alternatively, energy source 170 may include a semiconductor oscillator, such as a voltage controlled oscillator, configured to generate AC waveforms (e.g., AC voltage or current) with a constant or varying frequency. AC waveforms may include sinusoidal waves, square waves, pulsed waves, triangular waves, or another type of waveforms with alternating polarities. Alternatively, energy source 170 may include an electromagnetic field generator, an electromagnetic flux generator, or any mechanism for generating vibrating electrons. Consistent with disclosed embodiments, electromagnetic energy may be generated and applied to energy application zone 120 or a region within energy application zone 120 in the form of propagating electromagnetic waves at predetermined wavelengths, frequencies, phases, and/or amplitudes. Propagating electromagnetic waves may include resonating waves, evanescent waves, and waves that travel through a medium in any other manner.

Some embodiments of the invention may involve applying EM energy, e.g., RF energy, at specifically chosen modulation space elements, referred to herein as MSEs. The term "modulation space" or "MS" is used to collectively refer to all the parameters that may affect a field pattern in energy application zone 120 and all combinations thereof. In some embodiments, the MS may include all possible components that may be used and their potential settings (either absolute or relative to others) and adjustable parameters associated with the components. For example, the MS may include a plurality of variable parameters, the number of antennas, their positioning and/or orientation (if modifiable), the useable bandwidth, a set of useable frequencies and any combinations thereof, phases, amplitude (e.g., an amplitude difference between two waves having the same frequency), etc. The MS may have a number of variable parameters, ranging between one parameter only (e.g., a one dimensional MS limited to frequency variation only or phase variation only—or another single parameter), two or more dimensions (e.g., varying frequency and phase together within the same MS), or many more. Examples of energy source-related MSEs may include amplitude, frequency, and phase of EM waves. Examples of radiating element-related MSEs may include the type, number, size, shape, configuration, orientation and placement of antenna structures, such as radiating elements 125 (FIG. 1).

Apparatus 100 may also include one or more radiating elements 125 configured to emit or receive electromagnetic waves to or from energy application zone 120. As used herein, the terms "radiating element" and "antenna" may broadly refer to any structure from which electromagnetic energy may radiate and/or be received, regardless of whether the structure was originally designed for the purposes of radiating or receiving energy, and regardless of whether the structure serves any additional function. For example, a radiating element or an antenna may include an antenna which includes a plurality of terminals emitting in unison, either at the same time or at a controlled dynamic phase difference (e.g., a phased array antenna), aperture/slot antennas, one or more waveguides, directional couplers, patch antennas, fractal antennas, helix antennas, log-periodic antennas, spiral antennas, dipole antennas, loop antennas, slow wave antennas, leaky wave antennas, or any other structures capable of supplying electromagnetic energy to item 140 or receiving electromagnetic energy from item 140. Alternatively, radiating elements 125 may include any other suitable structure from which electromagnetic energy may be emitted, supplied, and/or applied.

In some embodiments, for example, where apparatus 100 includes more than one radiating element 125, each radiating element 125 may be steered to emit electromagnetic energy along the same direction, or various different directions. In some embodiments, radiating element(s) 125 may be located on one or more surfaces of the energy application zone. The location, orientation, and configuration of each radiating element 125 may be set before applying electromagnetic energy to item 140, or dynamically adjusted using processor 110 during the application of electromagnetic energy to item 140. Disclosed embodiments are not limited to a particular structure or location of radiating element(s) 125.

One or more of radiating element(s) 125 may be configured to receive electromagnetic energy. In other words, as used herein, the term "radiating element" refers broadly to any structure from which electromagnetic energy may radiate (e.g., be emitted) and/or be received, regardless of whether the structure was designed for the purposes of radiating or receiving energy, and regardless of whether the structure serves any additional function.

An apparatus or method in accordance with some embodiments may involve the use of one or more detectors 130 configured to detect signals and/or characteristics of signals associated with electromagnetic energy transferred to or received from energy application zone 120 by, for example, radiating element(s) 125. For example, as shown in FIG. 1, detector 130 may be coupled to a radiating element 125 that (when functioning as a receiver) receives electromagnetic waves from energy application zone 120. An indication of the characteristics of electromagnetic energy received by detector 130 may be sent from detector 130 to processor 110 through any wired, wireless, or optical transmission medium suitable for transmitting information.

Detector 130 may include an electrical and/or optical circuit that measures one or more parameters associated with received electromagnetic waves. For example, detector 130 may include a power meter configured to detect a power level associated with the received electromagnetic wave, an amplitude detector configured to detect an amplitude of the wave, a phase detector configured to detect a phase of the wave, a frequency detector configured to detect a frequency of the wave, an impedance detector configured to determine the input impedance of radiating element 125 encountered by energy source 170, and/or any other circuits suitable for detecting a characteristic of an electromagnetic wave. In some embodiments, detector 130 may include a directional coupler.

Detector 130 may be configured to detect predetermined characteristics of item 140 in energy application zone 120. In particular, detector 130 may be configured to detect the energy absorbed and/or reflected by item 140. Consistent with the presently disclosed embodiments, energy may be supplied and/or provided to one or more radiating elements 125. Energy supplied to a radiating element may result in energy emitted by the radiating element (referred to herein as "incident energy"). The incident energy may be delivered to zone 120, and may be in an amount equal to an amount of energy supplied to the emitting radiating elements 125 by energy source 170.

A portion of the incident energy may be dissipated in the object or absorbed by the object (referred to herein as "dissipated energy" or "absorbed energy"). Another portion may be reflected back to the emitting radiating element (referred to herein as "reflected energy"). Reflected energy may include, for example, energy reflected back to the emitting radiating element due to mismatch caused by the object and/or the energy application zone, e.g., impedance mismatch. Reflected energy may also include energy retained by one or more emitting radiating elements (e.g., energy that is emitted by the radiating element(s) but does not flow into the zone). The rest of the incident energy, other than the reflected energy and dissipated energy, may be transmitted to and received by one or more receiving radiating elements other than the emitting radiating elements (referred to herein as "transmitted energy."). Therefore, the incident energy ("I") supplied to the emitting antenna may include all of the dissipated energy ("D"), reflected energy ("R"), and transmitted energy ("T"), and may be expressed according to the relationship: $I=D+R+\Sigma T_i$, wherein subscript "i" indicates the reference number of the receiving radiating element(s). An indication of the detected characteristics, such as transmitted energy or reflected energy, may be sent to processor 110 for analysis. Based on the analysis, processor 110 may adjust the amount of electromagnetic energy to be applied to item 140.

Detector 130 may be configured to acquire information on the characteristics of item 140 periodically during the processing of the item. When characteristics are acquired periodically, processor 110 may be configured to adjust the amount of electromagnetic energy applied to item 140 based on the newly acquired characteristics of item 140.

In some embodiments, apparatus 100 may include more than one energy source 170. For example, more than one oscillator may be used for generating electromagnetic waveforms at differing frequencies. The electromagnetic waveforms, e.g., separately generated electromagnetic waveforms, may be amplified by one or more amplifiers 180. Accordingly, at any given time, radiating elements 125 may be caused to simultaneously emit electromagnetic waves at, for example, two different frequencies to energy application zone 120.

In some embodiments, apparatus 100 may include a modulator 175 for modulating parameters of the electromagnetic waveforms, e.g., the frequency of individual electromagnetic waves, and/or the relative phases of two or more electromagnetic waves. In some embodiments, modulator 175 may include at least one of a phase modulator, a frequency modulator, and an amplitude modulator configured to modify the phase, frequency, and amplitude of the AC waveform, respectively. For example, modulator 175 may include a phase modulator, which may be controlled to perform a predetermined sequence of time delays on an AC waveform, for example the phase of one AC waveform is increased by a number of degrees (e.g., 10 degrees) relative to the phase of another AC waveform or waveforms for each of a series of time periods. In some embodiments, processor 110 may dynamically and/or adaptively regulate modulation based on feedback from energy application zone 120.

For example, processor 110 may be configured to receive an analog or digital feedback signal from detector 130, indicating an amount of electromagnetic energy transferred to energy application zone 120, received from energy application zone 120, and/or absorbed by item 140. Processor 110 may then dynamically determine a time delay on an AC waveform, such that the phase of the AC waveform is increased by a number of degrees (e.g., 10 degrees) for each of a series of time periods, based on the received feedback signal. Processor 110 may be configured to regulate the phase modulator in order to alter a phase difference between two electromagnetic waves supplied to the energy application zone. In some embodiments, energy source 170 may be configured to supply electromagnetic energy at a plurality of phases, and processor 110 may be configured to cause the transmission of energy at a subset of the plurality of phases. By way of example, the phase modulator may include a phase shifter. The phase shifter may be configured to cause a time delay in the electromagnetic waveform in a controllable manner within energy application zone 120, delaying the phase of one electromagnetic waveform relative to another, e.g., from 0-360 degrees.

In some embodiments, modulator 175 may additionally or alternatively include a frequency modulator. The frequency modulator may be implemented using, for example, a semiconductor oscillator configured to generate an AC waveform oscillating at a predetermined frequency. The predetermined frequency may be selected by an input voltage, current, and/or other signal (e.g., an analog or digital signal or signals). For example, the frequency modulator may be implemented using a voltage controlled oscillator configured to generate waveforms at a frequency proportional to the input voltage.

Processor 110 may be configured to regulate an oscillator to sequentially generate AC waveforms oscillating at various frequencies within one or more predetermined frequency bands. In some embodiments, a predetermined frequency band may include a working frequency band, and processor 110 may be configured to cause the transmission of energy at frequencies within a sub-portion of the working frequency band. A working frequency band may be a collection of frequencies selected because, in the aggregate, they achieve a desired goal (for example: cooking various foods), and there is diminished need to use other frequencies in the band if that sub-portion achieves the goal. Once a working frequency band (or subset or sub-portion thereof) is identified, processor 110 may sequentially apply power at each frequency in the working frequency band (or a subset or sub-portion thereof). This sequential process may be referred to as "frequency sweeping." In some embodiments, each frequency may be associated with a feeding scheme, for example, a particular selection of MSEs. In some embodiments, processor 110 may be configured to select one or more frequencies from a frequency band based on the feedback signal provided by detector 130, and to regulate an oscillator to sequentially generate AC waveforms at these selected frequencies.

In some embodiments, processor 110 may be further configured to regulate an amplifier 180 to adjust amounts of energy delivered via one or more radiating elements 125, based on the feedback signal provided by detector 130. For example, detector 130 may detect an amount of energy reflected from energy application zone 120 and/or energy transmitted at a particular frequency, and processor 110 may be configured to cause the amount of energy delivered at that frequency to be low when the reflected and/or transmitted energy is low. Additionally or alternatively, processor 110 may be configured to cause one or more of radiating elements 125 to deliver energy at a particular frequency over a short duration when the reflected energy at that frequency is low.

Processor 110 may be configured to regulate amplifier 180 in order to alter an amplitude of at least one electromagnetic wave supplied to energy application zone 120. In some embodiments, energy source 170 may be configured to supply electromagnetic energy in a plurality of amplitudes, and processor 110 may be configured to cause the transmission of energy at a subset of the plurality of amplitudes. In some embodiments, the apparatus may be configured to supply electromagnetic energy through a plurality of radiating elements 125, and processor 110 may be configured to supply energy with differing amplitudes simultaneously to at least two radiating elements.

Apparatus 100 may also include a reading unit. The reading unit may be or include an image acquisition device 135. Image acquisition device 135 may include a charge-coupled device (CCD) based image sensor or a complementary metal-oxide semiconductor (CMOS) based image sensor, a Scientific CMOS based image sensor, or any other type of image acquisition device capable of capturing a whole or partial image. In certain embodiments, image acquisition device 135 may comprise a separate processor and memory that enable it to perform authentication functions. In other embodiments, image acquisition device 135 may pass, transmit, and/or send the acquired image information to processor 110.

In some embodiments, image acquisition device 135 may be incorporated into apparatus 100. For example, image acquisition device 135 may be located within energy application zone 120 or may be located near a user interface that is part of apparatus 100. For example, image acquisition device 135 may be located on top of apparatus 100, on the side of apparatus 100, or as part of an opening to energy application zone 120. When located in an opening to energy application zone 120, image acquisition device 135 may acquire an optical image as item 140 enters energy application zone 120. For example, image acquisition device 135 may additionally or alternatively be located on a doorsill of energy application zone 120 (e.g., cavity) such that when item 140 is inserted into zone 120, image acquisition device 135 may capture an optical image. In other embodiments, image acquisition device 135 may be an accessory operatively coupled to apparatus 100. For example, image acquisition device 135 may be peripherally located with respect to apparatus 100, and may be connected to processor 110 of apparatus 100 through a wireless or wired connection. In other embodiments, apparatus 100 may include one or more mirrors to increase a field of view of image acquisition device 135.

Apparatus 100 may also include an interface with a reading unit. The reading unit may be or include element reader 115, which reads data and/or information stored on and/or associated with a machine readable element. The machine readable element may be adapted for reading by AIDC technology and be referred to as an AIDC element. For example, element reader 115 may use any type of Auto ID Capture (AIDC) technology. Automatic Identification and Data Capture (AIDC) refers to the methods of automatically identifying objects, collecting data about them, and entering that data directly into computer systems. Technologies typically considered as part of AIDC include bar codes, Radio Frequency Identification (RFID), magnetic stripes, Optical Character Recognition (OCR), and smart cards. AIDC may also be referred to as "Automatic Identification," "Auto-ID," and "Automatic Data Capture." Element reader 115 may include a printed code reader (e.g., a barcode reader, a matrix code reader, etc.), an RFID reader, or a combination of such technologies. In some embodiments, apparatus 100 may include a plurality of element readers 115 of different kinds, e.g., an RFID reader and a barcode reader.

In certain embodiments one or more radiating elements 125 may perform one or more functions of element reader 115. For example, an RFID reader may include an RFID antenna for detecting and/or receiving information from an RFID tag and/or for transmitting information (e.g., instructions) to the RFID tag. In some embodiments, the RFID antenna may be one or more radiating elements 125. In such embodiments, a frequency band used for receiving information from or transmitting information to an RFID tag may differ from the band used for processing the object. For example, the frequency band used for reading may be low-frequency band (e.g., 125-134.2 kHz or 140-148.5 kHz) or high-frequency band (e.g., 13.5 MHz) while the band used for processing may be between 500 MHz to 1500 MHz or between 700 MHz to 1200 MHz or between 800 MHz-1 GHz. In other embodiments, the same frequency band may be used in different time slots.

In some embodiments, element reader 115 may be incorporated into apparatus 100. For example, element reader 115 may be located within energy application zone 120 or may be located near a user interface that is part of apparatus 100. For example, element reader 115 may be located on top of apparatus 100, on the side of apparatus 100, or as part of an opening to energy application zone 120. Additionally or alternatively, element reader 115 may be located on a doorsill of energy application zone 120 (e.g., cavity) such that when item 140 is inserted into zone 120, element reader 115 may read the machine readable element. In other embodiments, element reader 115 may be an accessory operatively coupled to apparatus 100. For example, element reader 115 may be peripherally located with respect to apparatus 100, and may be connected to processor 110 of apparatus 100 through a wireless or wired connection. In some embodiments, element reader 115 may be located in the same location as image acquisition device 135. In some embodiments, apparatus 100 may include one or more mirrors to increase a field of view of reader 115.

In some embodiments, processor 110 of apparatus 100 may be connected to an external server 160 through a network 150. For example, network 150 may include the Internet, a WAN or a LAN. External server 160 may store information used to determine processing instructions for various types of objects. In certain embodiments, server 160 may also store information used to authenticate an item before apparatus 100 processes the item. In some embodiments, memory 105 resides on server 160.

Apparatus 100 may also include additional sensors, such as temperature/humidity sensor 145 or weight/size sensor 155. These sensors may receive information, such as the temperature of item 140, the weight of item 140, or the humidity level in energy application zone 120 and may transmit or send the information to processor 110. The one or more sensors may be connected to processor 110 through any transmission medium suitable for transmitting information, e.g., wired, wireless, or optical. In certain embodiments, temperature sensor 145 may be supplied with item 140 and may communicate with apparatus 100.

Figure 2A:
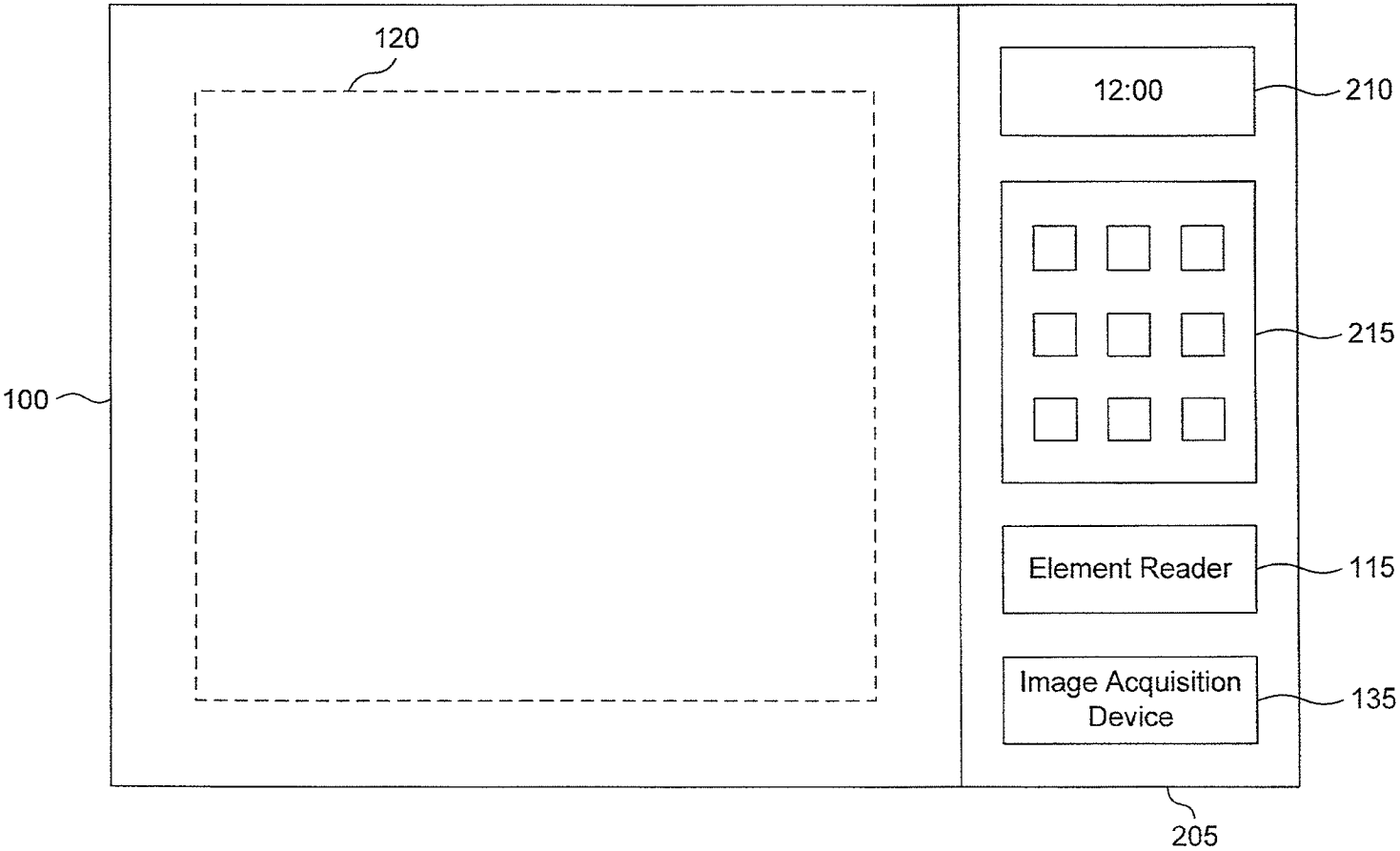
FIG. 2A is a diagram of the exterior of an exemplary apparatus for processing an item, in accordance with certain disclosed embodiments.

FIG. 2A is a diagram of the exterior of an exemplary apparatus for processing items, in accordance with disclosed embodiments. As shown in FIG. 2A, apparatus 100 may include a user interface 205. User interface 205 may include an input apparatus 215 and an output apparatus 210. Input apparatus 215 may include a keypad, a touch screen, a voice recognition device, or any other known device for receiving input from a user. Input apparatus 215 may transmit a user's inputs, such as desired preferences and/or instructions, to processor 110. Output apparatus 210 may include a display configured to display information for a user. For example, output apparatus 210 may prompt a user to select a desired processing outcome for an item. An example of a desired processing outcome may include cooking meat to rare, medium, or well-done or cooking vegetables al dente (firm), soft, or very soft. Output apparatus 210 may also communicate a problem with the oven or cooking instructions derived from the machine readable element associated with the item. In certain embodiments, input apparatus 215 and output apparatus 210 may be integrated into the same device, such as a display unit having a touch screen.

Figure 2B:
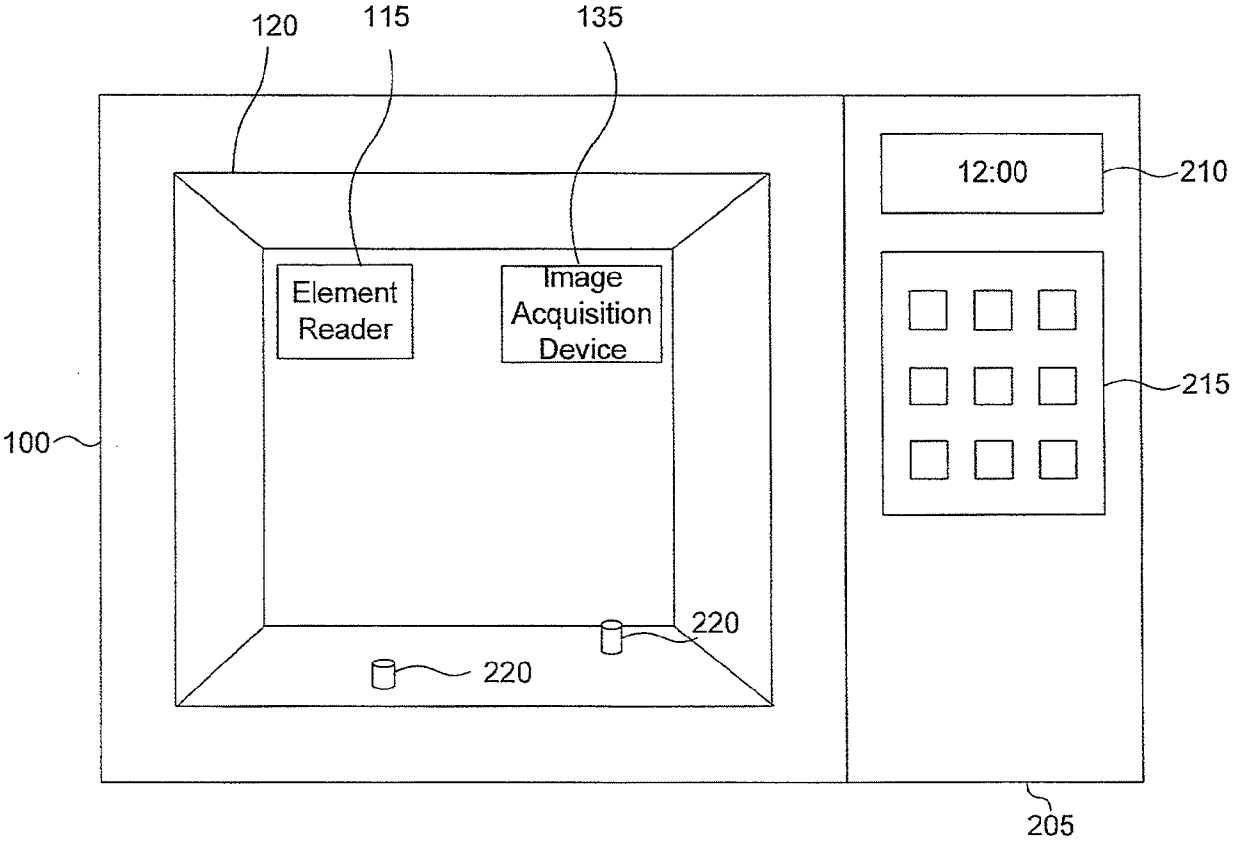
FIG. 2B is a diagram of the interior of an exemplary apparatus for processing an item, in accordance with certain disclosed embodiments.

As shown in FIG. 2A, reading units, such as element reader 115 and image acquisition device 135, may be located on the exterior of apparatus 100 as part of user interface 205. Although shown as part of user interface 205 in FIG. 2A, one or both of element reader 115 and image acquisition device 135 need not be a part of user interface 205. In the embodiment shown in FIG. 2A, the user may place an item in front of image acquisition device 135 and additionally in front of element reader 115. In other embodiments, image acquisition device 135 and element reader 115 may be co-located on user interface 205 (e.g., in the same window), and the user would only be required to present the item once (in front of one window). In some embodiments, as shown in FIG. 2B, reading units, such as image acquisition device 135 and/or element reader 115, may be located in an interior of apparatus 100 and the user may not be required to present the item in front of image acquisition device 135 and/or element reader 115 before it is entered into apparatus 100. In some embodiments, only one reading unit, for example image acquisition device 135 or element reader 115, may be located in the interior of apparatus 100. In certain embodiments, image acquisition device 135 may acquire image data at the same time that element reader 115 acquires data from a machine readable element. In other embodiments, one of the image data and the machine readable element data is acquired before the other.

FIG. 2B is a diagram of the interior of an exemplary apparatus for processing an item, in accordance with certain disclosed embodiments. As shown in FIG. 2B, the interior may contain positioning elements, for example projections 220 that may assist in the placement and/or positioning and/or orienting of item 140 in energy application zone 120. Additionally or alternatively, positioning elements may include lines, shapes, or text on a surface of energy application zone 120 that help position item 140. For example, a positioning element may include a drawing on the surface of zone 120 that matches the shape of item 140. Such placement may facilitate the reading of optical indicium (indicia) or machine readable element(s) associated with item 140 when element reader 115 and/or image acquisition device 135 is located within energy application zone 120.

Figure 3A:
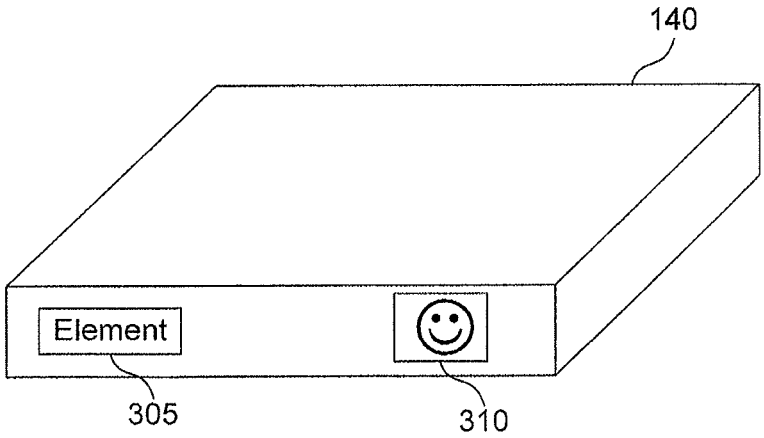
FIGS. 3A-3D are diagrams of exemplary items having machine readable elements and optical indicium, in accordance with certain disclosed embodiments.
Figure 3C:
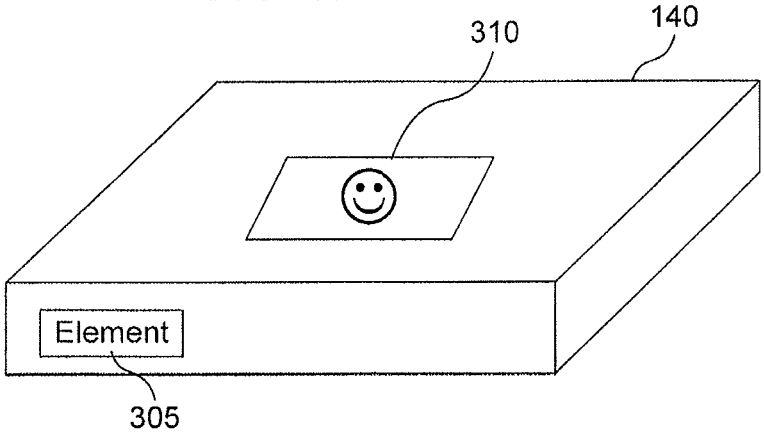
Figure 3B:
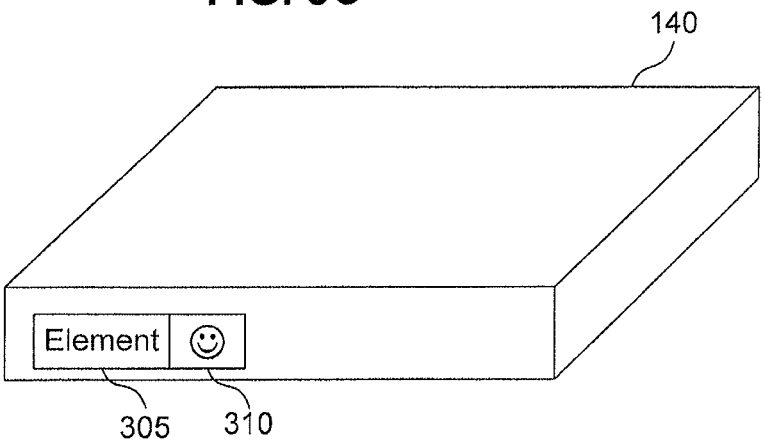

FIGS. 3A to 3C depict views of item 140 consistent with exemplary embodiments of the present disclosure. As shown in FIGS. 3A-3C, items 140 may include machine readable element 305 and/or optical indicium 310. As used herein, an optical indicium refers broadly to a visually discernable mark, sign, token, text, image, appearance, or indication. Optical indicium 310 may be used to indicate authentication regarding the item's origin (e.g., that the item is not a counterfeit). Additionally or alternatively, optical indicium 310 may be used as an authentication of the instructions on machine readable element 305 such that a "foreign" tag, for example, a price code, would not be erroneously regarded as processing information.

With reference to FIG. 3A, item 140 is described in connection with food and cooking. However, it will be understood that item 140 is not limited to food and may be any type of object receptive to processing with electromagnetic energy. Further, the placement of machine readable element 305 and optical indicium 310 in FIGS. 3A to 3C is exemplary only, and it will be understood that machine readable element 305 and optical indicium 310 are not limited to the locations or formats shown. As shown in FIG. 3A, machine readable element 305 and optical indicium 310 may be located on the same plane of the packaging of item 140.

In certain embodiments, machine readable element 305 and optical indicium 310 may be combined in a single element. For example, machine readable element 305 may be incorporated within or on optical indicium 310 to form a combined element. In another example, optical indicium 310 may be incorporated within or on machine readable element 305 to form a combined element. In some embodiments, a barcode or other machine-readable element may be a portion of the optical indicium.

In some embodiments, a single reader or sensor may be used for acquiring the optical indicium or the image information relating to the optical indicium and for acquiring the information from the machine readable element. For example, an image acquisition device may acquire an image of a combined element, and a processor (e.g., processor 110) may analyze the acquired image to recognize image portions that correspond to the machine readable element and image portions that correspond to the optical indicium. The processor may additionally retrieve the information coded by the machine readable element based on the recognized image portions. In some embodiment, processor 110 may retrieve information from a barcode without using a barcode reader.

Additionally or alternatively, the image may be analyzed by processor 110 and processor 110 may be configured to recognize image portion(s) that correspond to the optical indicium (e.g., a logo), and authenticate the item based on these image portion(s).

For example, a combined element (e.g., a combined barcode-indicium) may comprise a Coca-Cola® logo (e.g., in the form of a bottle) carrying a barcode. The bottle may be a registered trademark of the Coca Cola Company, and the barcode may identify the product. The identity of the product may be used to obtain processing information. A product without the bottle image may be identified, but not authenticated. An image acquisition device may capture an image of the product, and in the absence of the bottle the processor may deny authentication. Once the combined barcode-indicium is authenticated based on the indicium portion, the image may be analyzed to acquire the data of the barcode (e.g., the image may be analyzed to identify the product by the barcode), and information may be acquired from the barcode image. In some embodiments, the order may be reversed, and data from the barcode may be retrieved before authentication by the indicium.

Similarly, a combined element may be read by a machine readable element reader (e.g., element reader 115) alone. For example, the word "coke" may be written as a part of a 2D barcode, and other portions of barcode may encode some information regarding the item that carries the barcode. When the barcode is analyzed to retrieve the encoded information, the word-portion may be deciphered to a given string of alphanumeric or other signs, and only codes deciphered to include the given string of signs are authenticated. This is an example of an embodiment that may be carried out with a barcode reader, and does not require an image acquisition device.

Element reader 115, and/or image acquisition device 135, may be included in an accessory device (not shown), operatively coupled to apparatus 100 by wired or wireless communication. In some embodiments, the accessory device may include an interface for receiving input from a user. For example, the accessory may allow a user to set processing conditions of the product, for example, using a menu of processing options that may be available to the user via the interface. Additionally or alternatively, the accessory may be configured to authenticate and identify the item based on input obtained by reader 115 and/or device 135. Based on this identification, in some embodiments, the accessory may prompt a user for further processing instructions. For example, the accessory may identify the food to be a meat portion, and prompt the user to input a desired readiness degree (e.g., well done, medium, rare, etc.). The user may input the desired readiness degree to the accessory, and a corresponding signal may be sent from the accessory to the apparatus, e.g., to processor 110. In some embodiments, the signal may be sent wirelessly, for example, using a BluetTooth communication protocol, or over a wireless network, e.g., using WiFi communication. In some embodiments, the accessory may be configured to connect to server 160, e.g., via an Internet connection. The accessory may retrieve from server 160 processing instructions for the identified item, and send them to processor 110. In some embodiments, the accessory may include a memory for storing processing instructions for various items, and may send the stored instructions to processor 110. In some embodiments, before sending the stored instructions to processor 110, the accessory may check with server 160 to determine if the processing instructions on the server are different from those stored on the accessory's memory. In some embodiments, if the processing instructions on the server are updated with respect to those stored on the accessory's memory, the accessory may download the updated instructions from the server to replace the instructions stored on its memory. Otherwise, or in case of communication failure with server 160, the accessory may send the processing instructions stored therein to processor 110. In some embodiments, the accessory may have functions additional to operating apparatus 100, for example, the accessory may include a personal digital assistant (PDA) or a smart-phone.

As shown in FIG. 3B, for example, machine readable element 305 may be a part of optical indicium 310. In other embodiments, as shown in FIG. 3C, machine readable element 305 and optical indicium 310 may be alternatively located on different planes of the packaging of item 140.

Optical indicium 310 may be any image that can be optically recognizable. For example, optical indicium 310 may be a source indicator, such as a trademark or a logo indicating the origin of the item. Optical indicium 310 may include an image and/or text. The text may include a company name, company initials, a brand name, a slogan, or any other text that may be useful for indicating the origin of the item and/or for authenticating the item. While FIGS. 3A-3C show optical indicium 310 on packaging of an item, optical indicium 310 may also be located on or within the item itself. In certain embodiments, processor 110 may use a spatial relationship between visible features, for example, between one or more optical indicia 310 to authenticate item 140 before processing. Alternatively or additionally, processor 110 may use spatial relationship between optical indicium 310 and other visible features, such as an edge of item 140 or machine readable element 305 to authenticate item 140.

For example, in some embodiments, only items carrying optical indicium 310 and machine readable element 305 on opposing sides of the item are authenticated. In other embodiments, authentic items would require a first optical indicium on a first plane of the item and a second optical indicium on a second plane. Such embodiments may additionally require that the optical indicium be located at a specified location on the plane, within a set tolerance. In some embodiments, processor 110 may consider item 140 authentic when machine readable element 305 is located only along a given line defined by optical indicium 310, within a set tolerance. In other embodiments, authentic items may have a predetermined distance between the center of optical indicium 310 and a given line in a machine readable barcode. In certain embodiments, machine readable element 305 may contain information as to the location of optical indicium 310, causing processor 110 to ignore optical indicium located at different locations.

In certain embodiments, a spatial relationship between machine readable element 305 or optical indicium 310 and some other visible feature is used for authenticating the item. For example, an authentic item may require a specified relationship between machine readable element 305 and an edge of the item. Similarly, in some embodiments, a spatial relationship between optical indicium 310 and some other visible feature may be used for authenticating the item. For example, processor 110 may use a specified relationship between optical indicium 310 and a different optical indicium or an edge of the item to authenticate item 140. In some embodiments, authentication is based, wholly or partially, on spatial relationships between the optical indicium (or the machine readable element) and other features of item 140, such as a positioning element described herein.

In certain embodiments, optical indicium 310, or any part thereof, may be configured to change during processing of the item. For example, all or a portion of optical indicium 310 may be printed using special inks that change color, disappear, or otherwise change the appearance of optical indicium 310 when exposed to heat, electromagnetic energy, or humidity or a combination of two or more of these. In other embodiments, optical indicium 310 may contain special ink designed to appear when exposed to a stimulus, such as heat, RF energy, a certain level of humidity, or a combination of two or more of these. Thus, the appearance of optical indicium 310 may change, enabling image acquisition device 135 or processor 110 to detect a difference between optical indicium 310 before exposure to the stimulus and after exposure. In certain embodiments, such changes may render optical indicium 310 unrecognizable for authentication purposes and prevent optical indicium 310 from being used again for authentication purposes.

Machine readable element 305 may be implemented using any type of Auto ID Capture (AIDC) technology, such as an RFID tag, a printed code (such as a 2D barcode, a 1D barcode, a matrix code, etc.), or a combination of such technologies. Machine readable element 305 may include a resonance circuit having a unique resonance frequency that may function as its identification. Machine readable element 305 may also be implemented using machine-readable text, for example an alphanumeric code. Item 140 may have two or more machine readable elements 305 associated with it. Each machine readable element may contain different instructions for processing an item, for example, instructions for cooking meat to a different readiness (e.g., rare, medium-rare, medium, well done, etc.). In some embodiments, a single machine readable element may contain different instructions for processing an item, for example, instructions for cooking meat to a different readiness. In some embodiments, the user may select one of the instructions to achieve a desired outcome, for example, selecting medium-rare for cooking meat. Machine readable element 305 may be located on the packaging of item 140 or on or within the contents of item 140 itself. Machine readable element 305 may also be configured to change during processing of item 140. For example, components of an RFID tag may be configured to melt once reaching a predetermined temperature. A printed code, such as a barcode or matrix code, etc., may be printed with special ink that changes color in response to exposure to a specified temperature and/or humidity level and/or electromagnetic energy. The changes may cause all or a portion of machine readable element 305 to transition and/or transform to an unrecognizable state, becoming unreadable. In other embodiments, machine readable element 305 may contain information that only becomes readable through exposure to pre-determined levels of heat, pre-determined amount of electromagnetic energy, and/or humidity.

Figure 3D:
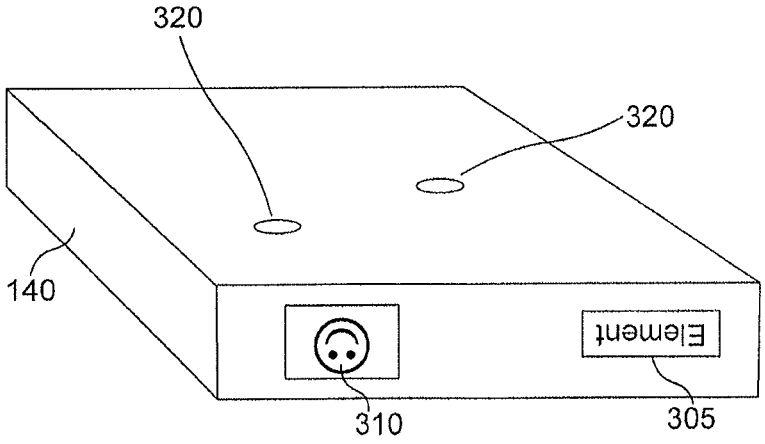

In some embodiments, item 140 may be provided with positioning elements that assist or direct the user in the proper placement of item 140 in energy application zone 120, so as to facilitate reading of optical indicium 310 and/or machine readable element 305 by the respective reading units. The placement may include position and/or orientation of item 140 in zone 120. The positioning elements may include text and/or graphics to assist in positioning item 140. The positioning elements may also include projections and/or indentations on item 140, such as indentations 320 shown in FIG. 3D. In some embodiments, apparatus 100 may include positioning elements on or within energy application zone 120 to facilitate positioning of item 140. For example, energy application zone 120 may include text and/or graphics on a surface matching the shape of item 140 or may include stops (such as pins or similar projections, or indentations) to assist in the placement of item 140, such as projections 220 shown in FIG. 2B. In some embodiments, indentations 320 provided on item 140 may match and/or correspond to projections 220. In other embodiments, the size and shape of item 140 may be configured to cooperate with indentations or projections on or within energy application zone 120.

FIGS. 4A-4E illustrate exemplary processing information using data encoded on machine readable element(s) 305 associated with item 140, in accordance with disclosed embodiments. The information available using machine readable element 305 may enables processor 110 to determine and/or carry out instructions for processing item 140. Although the processing information shown in FIGS. 4A-4E relates to cooking, disclosed embodiments are not limited to cooking processes.

The information shown in FIGS. 4A-4E may be encoded directly on machine readable element 305, or the information may be stored in a memory, such as memory 105 and/or a memory associated with server 160. When the information is stored in memory, machine readable element 305 may be encoded with data, e.g., an identification number (also known as ID tag), used to access the information stored in the memory.

Figure 4A:
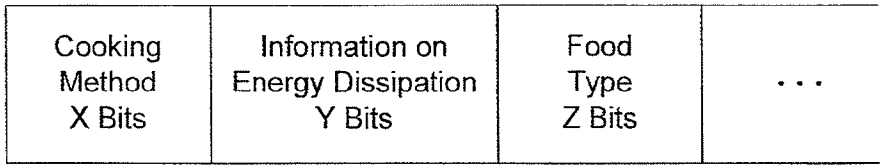

In some embodiments, as shown in FIG. 4A, the first X bits of the processing information may provide the cooking method. For example, '00' may indicate defrosting, '01' may indicate heating, '10' may indicate cooling, and '11' may indicate maintaining the item at a specified temperature. The following Y bits may provide information on the amount of energy to be dissipated in the item. For example, '01' may indicate one kilo joule (KJ) and '10' may indicate two KJ. In other embodiments '01' may indicate one kilo calorie (kcal) and '10' may indicate two or other amount of kcal. In still other embodiments, the amount of energy may be represented by energy per weight of the item, for example, 2000 KJ/Kg. In some embodiments, other information may be included in the processing information, such as the total energy to be delivered to the object, the object type, the food type, item weight, or the target temperature of the object. For example, when the Y bits represent cooking energy per weight of the item, the Y bits may be 1500 KJ/Kg and the item type may be indicated to be vegetables. In some embodiments, the next Z bits may indicate food type. Each cooking method and its associated information may be considered a cooking step.

Figure 4B:
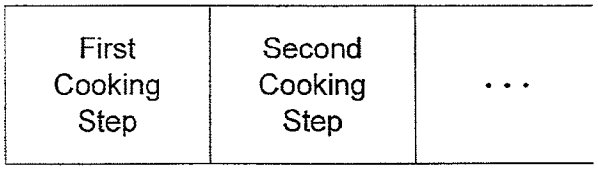

In some embodiments, as shown in FIG. 4B, several cooking steps may be provided using the machine readable element. For example, a first cooking step may include defrosting the object and a second cooking step may include heating the object to a given temperature. Exemplary cooking instructions include (1) Defrost the object until uniform defrosting is obtained; (2) Heat the object to 35 degrees centigrade; (3) Hold the object at 35 degrees centigrade for 5 minutes; and (4) Provide the object with 500 KJ of energy.

Figure 4C:
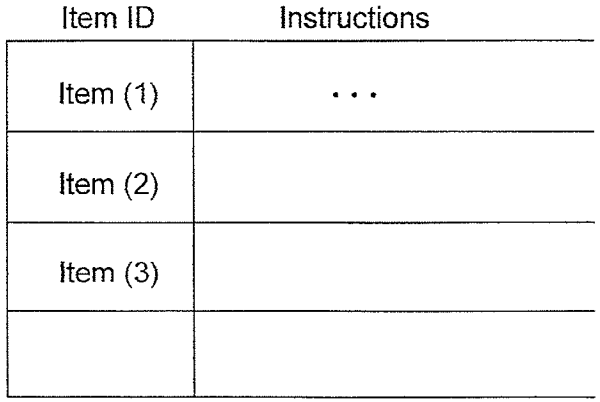

In some embodiments, as shown in FIG. 4C, cooking steps are provided on the machine readable element for several different items. For example, an item may include a vegetable, a salad, and a steak. The processing information from the machine readable element associated with the item may include different cooking information for the vegetable (Item (1)), the salad (Item (2)), and the steak (Item (3)). In some embodiments, the position of each item in the energy application zone may be indicated, for example, by the user, by information on a machine readable element, and/or detected by detector 130. For example, when item 140 is a tray with various food items deposited at specific locations in the tray, a machine readable element may indicate the position on the tray for each separate item. For example, a machine readable element may indicate that the vegetable (Item (1)) is located at the upper right quarter of the tray, the salad (Item (2)) is located at the upper left quarter of the tray, and the steak (Item (3)) is located at the bottom of the tray. In other embodiments, detector 130 may determine the position of a specific item in the tray by detecting the properties of each item (e.g. dielectric properties, energy absorption characteristics). In some embodiments, each item may be processed separately, after being taken out of the packaging, and a user may specify which item is currently being processed. In other embodiments, the oven may heat different locations within the energy application zone differently, thus allowing the processing of the different instructions for the different items simultaneously.

In other embodiments, as shown in FIG. 4D, the information from the machine readable element may include processing instructions for more than one processing outcome. For example, the processing information may include one set of cooking steps (e.g., processing information) for cooking meat to rare, another set of cooking steps for cooking meat to medium, and yet another set of cooking steps for cooking meat to well-done. Alternatively, the information may include one set of cooking steps for cooking vegetables to al dente (firm), another set for cooking the vegetables to medium, and a third set for cooking the vegetables to soft. Apparatus 100 may prompt a user, for example, through user interface 205, to select one of the processing outcomes and, after receiving the user's selection, cook the item in accordance with the selected outcome. In certain embodiments, several machine readable elements may be provided, each with one of the plurality of processing outcomes, and the user may be prompted to remove all of them except one.

In some embodiments, as shown in FIG. 4E, the information from the machine readable element may indicate cooking instructions that correspond to different object characteristics obtained from the object, e.g., different dissipation ratios. In some embodiments, a machine readable element may include a 2D barcode. For example, an object characteristic may include the dissipation ratio for the object. A dissipation ratio may be a value indicative of the energy absorbable by the object at each of a plurality of MSEs, e.g., at each of a plurality of frequencies of electromagnetic energy. During an MSE sweep, for example, processor 110 may be configured to control energy source 170 such that energy is sequentially supplied to an object at a series of MSEs. Processor 110 might then receive a signal indicative of energy reflected at each MSE. Processor 110 may also receive a signal indicative of the energy transmitted to other antennas at each MSE. Using a known amount of incident energy supplied to the antenna and a known amount of energy reflected and/or transmitted (e.g., thereby indicating an amount of energy absorbed at each MSE), processor 110 may calculate or estimate an absorbable amount of energy at each MSE, e.g., a dissipation ratio. Alternatively, processor 110 may use an indicator of reflection and/or transmission as a value indicative of absorbable energy at each MSE.

Processor 110 may use detector 130 to obtain information regarding the dissipation ratio or a different value indicative of absorbable energy of item 140 after it has been placed in energy application zone 120. After determining the dissipation ratio of item 140, processor 110 may select the cooking instructions that correspond to the determined dissipation ratio. The machine readable element may include information on other factors that may influence the cooking instructions, for example: the degree of aging, date of butchering, packaging date, aging method, humidity level, non aging storage conditions, aging time, fat content, cut type, cut weight, etc.

Figure 5:
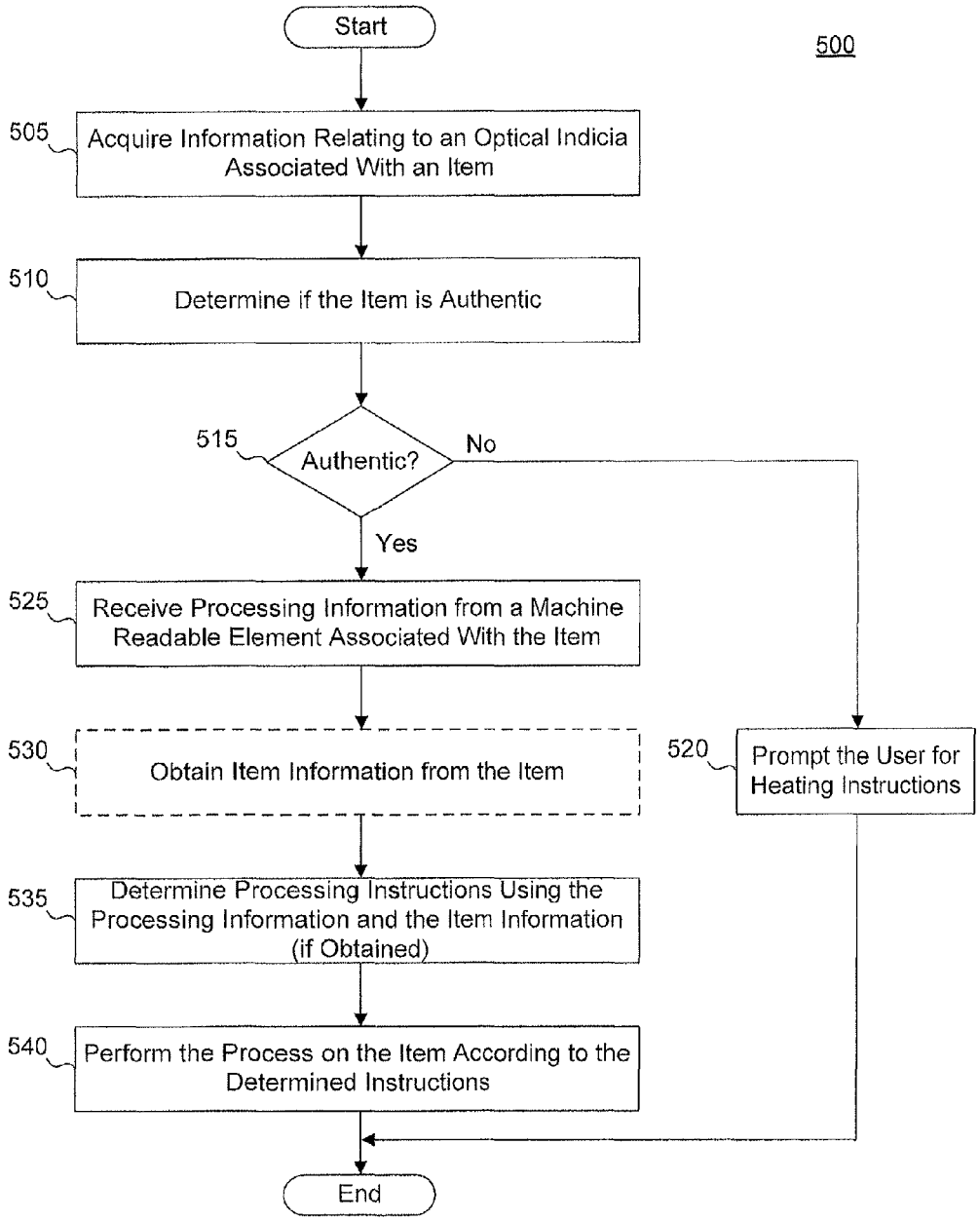
FIG. 5 is a flow chart illustrating an exemplary process of authenticating an item, in accordance with certain disclosed embodiments.

FIG. 5 is a flow chart illustrating an exemplary process 500 of authenticating an item. Although the method in FIG. 5 is illustrated as a series of steps, it will be understood that non-dependent steps may be performed in any order, or in parallel.

Process 500 may be initiated in various ways. For example, process 500 may begin by a user providing input to interface 205. Process 500 may also begin when processor 110 detects the presence of an item in energy application zone 120 by, for example, receiving input from weight sensor 155 or a signal from detector 130 that indicates that energy application zone 120 is no longer empty. For example, detector 130 and/or processor 110 may discern the difference between feedback from an empty energy application zone 120 and feedback from the presence of an item in energy application zone 120. Other types of sensors may also be used, such as temperature sensor 145 detecting a change in temperature. In some embodiments where image acquisition device 135 and/or element reader 115 are located within energy application zone 120, processor 110 may begin process 500 upon a signal from device 135 or reader 115. In other embodiments, process 500 may begin after a predetermined time period elapses after receiving a signal from device 135 or reader 115, regardless of where device 135 and reader 115 are located.

In Step 505, image acquisition device 135 may acquire information relating to an optical indicium associated with an item, for example indicium 310. In some embodiments, processor 110 may use output apparatus 210 to request that the user place and/or position optical indicium 310 in front of image acquisition device 135. Information relating to an optical indicium may be obtained by imaging all or a portion of the indicium. The information may also include information relating to a relationship between one or more optical indicia and one or more other visible features associated with the item. For example, the distance between the center point of a machine readable element and the center point of the optical indicium may be calculated using the acquired image information. Alternatively, the distance between the top of the optical indicium and the top edge of item 140 may be calculated using the acquired image information. The information may also include the distance between two or more optical indicia associated with item 140.

In other embodiments, the information may include a size of the item. For example, image acquisition device 135 may acquire all or part of indicium 310 and the length and width of the item. The information may be used to determine if the acquired size of the item is within a set tolerance of a predetermined size. In yet other embodiments, information obtained using a weight sensor may be used in addition to the information acquired using image acquisition device 135.

Next, in Step 510, a determination is made as to whether the item is authentic. In some embodiments processor 110 may make this determination. For example, processor 110 may include a digital signal processing module and/or an image recognition module. Image acquisition device 135 may send the captured image to processor 110, where the image data is analyzed for authentication. For example, processor 110 may compare the acquired image data to pre-defined images. The pre-defined images may be stored in memory 105, or in memory associated with server 160. In certain embodiments, processor 110 may select a portion of the captured image so that additional data besides and/or in the vicinity of the optical indicium is excluded.

Disclosed embodiments may include other methods of authenticating the item in addition to or as an alternative to image comparison. As discussed above, the spatial relationship between optical indicia or between an optical indicia and another feature of the item may be used. Processor 110 may calculate a distance between a point on the optical indicium and a point on another feature, such as a second optical indicium, or a machine readable element, and determine if the distance corresponds to a pre-defined value (within a set tolerance). Processor 110 may also use the relative placement of two or more optical indicia. Processor 110 may also calculate the size or weight of the item and compare the size or weight to a pre-defined size or weight associated with all or part of the optical indicium. Processor 110 may determine whether the item is authentic based on whether the comparison falls within a set tolerance.

In other embodiments, image acquisition device 135 may contain a digital signal processor module and/or an image recognition module. Thus, image acquisition device 135 may make the authentication determination described above without or in addition to sending the captured image to processor 110. Image acquisition device 135 may send a signal to processor 110 indicating that it found the item to be authentic, or that it failed to authenticate the item.

When the item is determined to be non-authentic (e.g., a counterfeit) (Step 515, No), then, in Step 520, processor 110 may prompt the user for heating instructions using, for example, user interface 205. When an item is not authentic, processor 110 may not use the processing information from the machine readable element to determine processing instructions, but may instead obtain instructions using the user interface. In some embodiments, when the item is determined to be non-authentic, processor 110 may decide not to process the item. For example, processor 110 may not apply EM energy to the item when the item is non-authentic.

When the item is determined to be authentic (Step 515, Yes), then in Step 525, processor 110 may receives processing information using and/or from a machine readable element associated with the item. In some embodiments, the user may be requested, e.g., by output apparatus 210 of user interface 205, to place and/or position machine readable element 305 in front of element reader 115. In certain embodiments, step 525 may have been performed at the same time or earlier than Step 505. For example, element reader 115 may have received the processing information from the machine readable element and transmitted the information to processor 110, or element reader 115 may wait for a signal from processor 110 to transmit the information. In other embodiments, element reader 115 may read the processing information and wait for a signal from processor 110 to transmit the information to processor 110. In certain embodiments, element reader 115 may query processor 110 to determine the authenticity of the item before reading any processing information from machine readable element 305. In some embodiments, information from machine readable element 305 may be used in the authentication process. In some embodiments, element reader 115 may wait for a signal from processor 110 to read processing information from machine readable element 305. In such embodiments, processor 110 may signal element reader 115 once the item has been authenticated.

In optional Step 530, applicable to some embodiments of the present disclosure, item information may be obtained from the item (e.g., using optional detector 130 and/or temperature sensor 145). In certain embodiments, step 530 may have been performed at the same time or earlier than Step 525 and/or 505. For example, detector 130 may receive feedback, e.g., electromagnetic waves, from energy application zone 120. Processor 110 may determine energy absorption characteristics of item 140 using the information obtained from the received electromagnetic waves. The energy absorption characteristics may include dielectric properties, a dissipation ratio, dissipation ratios in various MSEs, an amount of electromagnetic energy reflected and/or transmitted from energy application zone 120, and/or other characteristics. For example, processor 110 may determine a value indicative of energy absorbable by the object at each of a plurality of MSEs, e.g., at each of a plurality of frequencies. This may occur through a sweep, e.g., frequency sweep. A value indicative of the absorbable energy may be a dissipation ratio associated with each of a plurality of MSEs, e.g., with each of a plurality of frequencies. In other embodiments, processor 110 may receive an indication of a size or weight of the item. In some embodiments, processor 110 may determine energy absorption characteristics and/or other characteristics of item 140 using information obtained from one or more sensors provided in energy application zone 120, for example: a temperature sensor and a humidity sensor, e.g., sensor 145. The one or more sensors may send processor 110 a signal (e.g., a feedback signal) or a plurality of signals with one or more characteristics of item 140, e.g. item temperature. In some embodiments, two or more sensors may be provided, each sending a signal with different criteria of the item.

In Step 535, processor 110 may determine processing instructions using the processing information obtained from the machine readable element. For example, processor 110 may translate an identifier, e.g., ID tag, into processing instructions using a lookup table. In such embodiments, the machine readable element may contain an identifier that corresponds to processing instructions in a lookup table. The lookup table may be stored in memory 105 and/or may be stored remotely (e.g., on server 160) and may be accessible for example via network 150. In certain embodiments, the processing instructions may be stored directly on the machine readable element in a format such as that discussed above with regard to FIGS. 4A-4E.

In some embodiments, processor 110 may also use item information obtained in optional Step 530 to determine the processing instructions. For example, processor 110 may obtain a dissipation ratio (DR) value from item 140 after it has been placed in energy application zone 120. Processor 110 may use the dissipation ration for item 140, e.g., DR(1), to obtain processing instructions associated with DR(1) from machine readable element 305, using a structure similar to the one illustrated in FIG. 4E. In other embodiments, the instructions may be obtained using an identifier from machine readable element and a look-up table similar to the one illustrated in FIG. 4E.

Examples of processing instructions that may be determined by processor 110 may include instructions for controlling the frequency, phase, and/or amplitude of the electromagnetic signal and/or time duration for applying the signal to attain a desired processing outcome.

In some embodiments, the processing instructions may include a target total amount of energy to be dissipated in/absorbed by the item, and/or specific MSE(s) used to achieve the target total amount of energy. In certain embodiments, the power and/or time duration at which each MSE is applied may be determined by a feedback from the item. In some embodiments, the feedback may be indicative of the total energy absorbed by the item. In such embodiments, the feedback may be compared to the target total energy and when the feedback indicates that the item has absorbed the target total energy, the process may be considered complete. In other embodiments, the feedback may determine the power and/or time duration at which each MSE is applied regardless of the target total energy amount of energy received (directly or indirectly) from the machine readable element.

In some embodiments, processor 110 may determine processing instructions using the processing information obtained from the machine readable element and additional inputs and/or instructions provided by the user, e.g., by user interface 205. For example, as described above, machine readable element may contain different instructions, e.g., instructions for cooking meat to different outcomes, and the user may input a desired outcome.

At Step 540, processor 110 may cause the processing of the item in accordance with the processing instructions. In certain embodiments, processing the item may cause machine readable element 305 and/or optical indicium 310 to change, as discussed above. In certain embodiments, detector 130 may obtain item information several times during the processing. In such embodiments, processor 110 may dynamically determine the processing instructions. For example, a phase change, such as melting ice into water, may alter the absorption properties of item 140. Detector 130 may detect the change in properties and processor 110 may alter or initiate a processing instruction as a result of the detection.

In some embodiments, processor 110 may wait for user input and/or for input from sensors, e.g., weight and/or size sensors, before performing one or more of steps 505, 525, and 540. In some embodiments, apparatus 100 may include weight or size sensor 155, e.g., in energy application zone 120. In certain embodiments, processor 110 may be configured to begin processing item 140 in response to receiving an output from weight or size sensor 155 indicating the presence of item 140 in energy application zone 120. Information from the weight or size sensor may also be used to determine cooking instructions when, for example, the instructions include an amount of energy to apply per kilogram or milliliter (or other weight or size unit measurement). Alternatively or additionally, processor 110 may sweep energy application zone 120 (e.g., cavity) for an indication of item placement through, for example, a visual indication, a dielectric indication, a temperature change, or some other feedback indicative of an item in energy application zone 120 rather than an empty energy application zone 120. Processor 110 may wait for such an indication before beginning performance of the process on item 140. Alternatively or additionally, the processor may receive an indication of item placement from other types of sensors, such as detent sensors placed on projections or within indentations within processing area, such as projections 220 shown in FIG. 2B.

Figure 6:
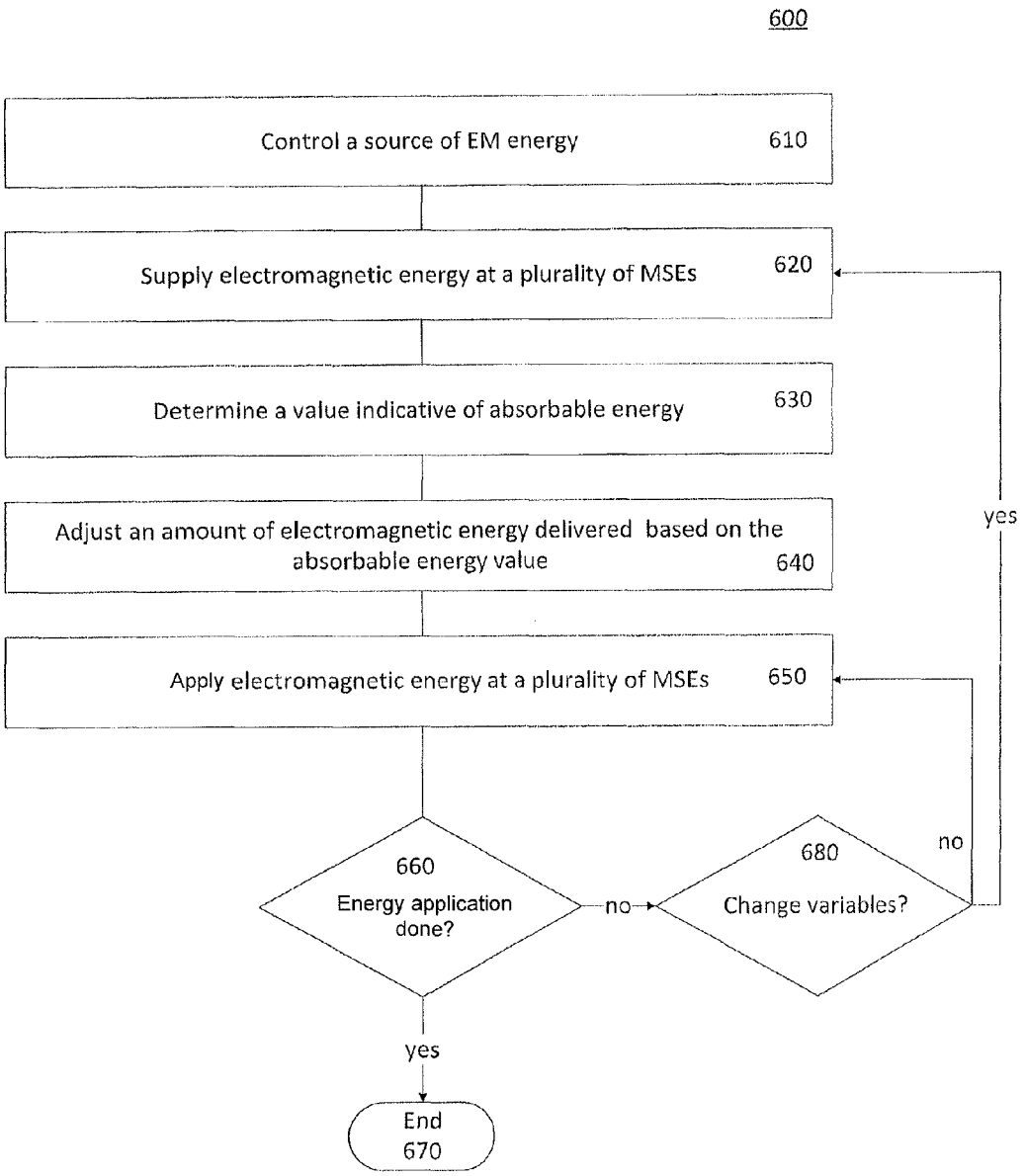
FIG. 6 is a flow chart illustrating an exemplary process for applying electromagnetic energy to an energy application zone, in accordance with certain disclosed embodiments.

FIG. 6 illustrates a flow chart of an exemplary process for applying electromagnetic energy to an object in accordance with some embodiments. Electromagnetic energy may be applied to an object, for example, through at least one processor 110 implementing a series of steps of method 600 of FIG. 6. Although the process in FIG. 6 is illustrated as a series of steps, it will be understood that non-dependent steps may be performed in any order, or in parallel.

In certain embodiments, process 600 may involve controlling a source of electromagnetic energy (Step 610), such as energy source 170. By way of example only, in Step 610, processor 110 may be configured to control electromagnetic energy application in apparatus 100, described above.

In Step 620, the source may be controlled to supply electromagnetic energy at a plurality of MSEs (e.g., at a plurality of frequencies and/or phases and/or amplitudes etc.) to at least one radiating element 125. The electromagnetic energy may be supplied using any of the various techniques described above, including frequency sweeping. Processor 110 may regulate apparatus 100 to supply energy to at least one emitting radiating element 125 at multiple MSEs. Additionally or alternatively, other schemes for controlling energy source 170 may be implemented. For example, one or more processing instructions and/or other information may be obtained from a machine readable element (e.g., a barcode or RFID tag, etc.), as discussed above.

In Step 630, the method may further include determining a value indicative of energy absorbable by the object at each of the plurality of MSEs. An absorbable energy value may include any indicator—whether calculated, measured, derived, estimated, or predetermined—of an object's capacity to absorb energy at a particular MSE. For example, processor 110 may be configured to determine an absorbable energy value, for example a dissipation ratio, associated with each MSE.

At Step 640, the process may also include adjusting an amount of electromagnetic energy incident or delivered at each of the plurality of MSEs based on the absorbable energy value at each MSE. For example, processor 110 may determine an amount of energy to be delivered at each MSE as a function of the absorbable energy value associated with that MSE.

In some embodiments, processor 110 may choose not to use all possible MSEs. For example, a choice may be made not to use all possible frequencies in a working band, such that the emitted frequencies are limited to a sub band of frequencies, for example, where the Q factor in that sub band is smaller or larger than a threshold. Such a sub band may be, for example, 50 MHz wide, 100 MHz wide, 150 MHz wide, 200 MHz wide, or more.

In some embodiments, processor 110 may determine a weight, e.g., power level, used for supplying the determined amount of energy at each MSE, as a function of the absorbable energy value. For example, the amplification ratio of amplifier 180 may be changed inversely with the energy absorption characteristic of item 140 at each MSE. In some embodiments, when the amplification ratio is changed inversely with the energy absorption characteristic, energy may be supplied for a constant amount of time at each MSE. Alternatively or additionally, processor 110 may determine varying durations at which the energy is supplied at each MSE. For example, the duration and power may vary from one MSE to another, such that their product inversely correlates with the absorption characteristics of the object. In some embodiments, processor 110 may use the maximum available power at each MSE, which may vary between MSEs. This variation may be taken into account when determining the respective durations at which the energy is supplied at maximum power at each MSE. In some embodiments, processor 110 may determine both the power level and time duration for supplying the energy at each MSE.

In Step 650, the method may also include emitting, applying, and/or supplying electromagnetic energy at a plurality of MSEs. Respective weights may be assigned to each of the MSEs, at which energy is to be applied (Step 640) based, for example, on the absorbable energy value (as discussed above). Electromagnetic energy may be supplied to energy application zone 120 via one or more radiating elements 125. In some embodiments, MSEs may be swept sequentially, e.g., across a range of MSEs or, along a portion of the range.

In Step 660, processor 110 may determine if the energy application should be terminated. For example, energy application may be interrupted periodically (e.g., several times a second) for a short period of time (e.g., a few milliseconds or tens of milliseconds) in order to determine if the energy application termination criteria have been met. In some embodiments, the termination criteria may be provided by the machine readable element, e.g., a desired temperature, an amount of energy to be dissipated in and/or delivered to the item. The energy application termination criteria may vary depending on the type of processing or application performed. For example, for a heating application, termination criteria may be based on time, temperature, total energy absorbed, or any other indicator that the process is complete. For example, heating may be terminated when the temperature of item 140 rises to a predetermined temperature threshold. If it is determined in Step 660 that energy application should be terminated (Step 660: yes), energy application may end (Step 670). In another example, in a thawing application, termination criteria may be any indication that the entire object is thawed. Processor 110 may determine that the object is thawed using the dissipation ratio as a function of MSE because the dissipation ration may be different for frozen and thawed objects.

If the criterion or criteria for termination have not been met (Step 660: no), it may be determined if any variables characterizing the application of energy (e.g., how much power is applied at each MSE) should be changed (Step 680). If not (Step 680: no), the process may return to Step 650 to continue application of electromagnetic energy according to the originally-applied variables. Otherwise (Step 680: yes), the process may return to Step 620 to supply electromagnetic energy according to new variables. For example, after a time has lapsed, the object properties may have changed; which may or may not be related to the electromagnetic energy application. Such changes may include a temperature change, a transposition of the object (e.g., if placed on a moving conveyor belt or on a rotating plate), a change in shape (e.g., melting or deformation for any reason) or volume (e.g., shrinkage or expansion), water content (e.g., drying) or flow rate, a change in phase of matter, and/or chemical modification, etc. Consequently, the variables of the applied electromagnetic energy may be changed to account for these changes in the object. The new variables that may be determined may include a new set of MSEs, an amount of electromagnetic energy incident or delivered at each of the plurality of MSEs, amplitude (e.g., power level), and duration at which the energy is supplied at each MSE. Consistent with some of the presently disclosed embodiments, fewer MSEs may be swept in a second iteration of Step 620 performed during the energy application phase than those swept in an initial iteration of Step 620 performed before the energy application phase.

Disclosed embodiments are not limited to process 600 for applying electromagnetic energy to an object. One of ordinary skill will understand that the disclosed embodiments may also be used with other methods.

Various embodiments are described herein in connection with authenticating an item before processing and determining instructions for processing an item using electromagnetic energy applied to an energy application zone. Persons of ordinary skill in the art will appreciate that principles of energy application discussed herein may be applied across various forms of energy application zones, and for a variety of purposes other than or including heating. In many respects, it is these broader principles that are the subject of the appended claims.

In the foregoing Description of Exemplary Embodiments, various features are grouped together in a single embodiment for purposes of streamlining the disclosure. This method of disclosure is not to be interpreted as reflecting an intention that embodiments require more features than are expressly recited in each claim. Rather, as the following claims reflect, inventive aspects lie in less than all features of a single foregoing disclosed embodiment. Thus, the following claims are hereby incorporated into this Description of the Exemplary Embodiments, with each claim standing on its own as a separate embodiment.

Moreover, it will be apparent to those skilled in the art from consideration of the specification and practice of the present disclosure that various modifications and variations can be made to the disclosed apparatuses and methods without departing from the scope of the claims. Thus, it is intended that the specification and examples be considered as exemplary only, with a true scope of the present disclosure being indicated by the following claims and their equivalents.

What is claimed is:

1. A device for processing items, comprising:

an interface configured to receive data from a machine readable element, wherein the machine readable element is associated with an item to be processed by the device;

an image acquisition device configured to acquire image information relating to an optical indicium associated with the item;

at least one processor configured to:

verify authenticity of the item based upon the image information acquired by the image acquisition device, the authenticity indicating that the item is not a counterfeit; and after the authenticity of the item is verified, cause the item to be processed in accordance with one or more instructions, wherein the one or more instructions are based on the data received from the machine readable element;

an energy application zone;

an RF energy source configured to provide RF energy to the energy application zone to process the item; and a detector configured to provide item information relating to the item to be processed based on signals associated with RF energy received from the energy application zone in response to RF energy provided to the energy application zone by the RF energy source and the processor is configured to determine the one or more instructions for processing the item based on the data and the item information, wherein the item information includes an amount of energy absorbed by the item at a plurality of modulation space elements and the at least one processor determines the one or more instructions for processing the item based on an amount of energy absorbed by the item at each of a plurality of modulation space elements.

2. The device of claim 1, wherein the at least one processor is configured to receive the data after the item is authenticated.

3. A device for processing items, comprising:

an interface configured to receive data from a machine readable element, wherein the machine readable element is associated with an item to be processed by the device;

an image acquisition device configured to acquire image information relating to an optical indicium associated with the item; and at least one processor configured to:

verify authenticity of the item based upon the image information including a location of the optical indicium relative to one or more other features associated with the item;

and after the authenticity of the item is verified, cause the item to be processed in accordance with one or more instructions, wherein the one or more instructions are based on the data received from the machine readable element.

4. The device of claim 3, wherein the one or more other features include at least a portion of the machine readable element.

5. A device for processing items, comprising:

an interface configured to receive data from a machine readable element, wherein the machine readable element is associated with an item to be processed by the device;

an image acquisition device configured to acquire image information relating to an optical indicium associated with the item; and at least one processor configured to:

verify authenticity of the item based upon the image information acquired by the image acquisition device;

and after the authenticity of the item is verified, cause the item to be processed in accordance with one or more instructions, wherein the one or more instructions are based on the data received from the machine readable element;

wherein the interface is configured to receive the data from a reading unit configured to read information from the machine readable element and the device further comprises at least one positioning element located in a cavity of the device and configured to orient the item at a predetermined orientation with respect to the reading unit.

6. A method for determining instructions for processing an item, comprising performing, using at least one processor, the operations of:

verifying authenticity of the item based upon image information relating to at least one optical indicium associated with the item;

receiving data obtained from a machine readable element located on a packaging of the item or on or within the contents of the item; and determining one or more instructions for processing the item based at least in part on processing information read from the machine readable element.

7. The method according to claim 6, further comprising:

acquiring, from a user, via a user interface, item information regarding the item to be processed before processing the item; and determining the one or more instructions for processing the item using at least the processing information and the item information.

8. The method according to claim 6, wherein the determining is responsive to the authentication.

9. The method according to claim 6, wherein the image information includes a part of the optical indicium.

10. The method according to claim 6, further comprising causing an energy source to apply RF energy to an energy application zone encompassing the item in accordance with the one or more instructions.

11. The method according to claim 6, wherein verifying the authenticity of the item includes receiving an indication from an image acquisition device that the item is not a counterfeit.

12. The method according to claim 6, wherein determining the one or more instructions includes accessing a memory, based on the processing information read from the machine readable element, and determining the one or more instructions based on information stored in the memory.

13. The method according to claim 6, wherein authenticating the item depends at least partially upon a location of the at least one optical indicium relative to one or more other features associated with packaging of the item.

14. The method according to claim 6, further comprising:

acquiring, based on an output of at least one detector, item information from the item before processing the item; and determining the one or more instructions for processing the item using at least the processing information and the item information, wherein the item information includes one or more values associated with electromagnetic energy absorption characteristics of the item.

15. The method of claim 14, wherein the item information includes an amount of energy absorbed by the item.

16. The method of claim 15, further comprising determining one or more dissipation ratios based on the amount of energy absorbed by the item at each of a plurality of modulation space elements and determining the one or more instructions for processing the item based on the one or more dissipation ratios.

17. The method according to claim 14, wherein the item information is acquired periodically during the processing of the item, and wherein the processor is further configured to modify the one or more instructions for processing the item based on the periodic determinations.

* * * * *